US011854386B2

(12) United States Patent
Lin

(10) Patent No.: US 11,854,386 B2
(45) Date of Patent: Dec. 26, 2023

(54) VEHICLE RIGHT-OF-WAY MANAGEMENT METHOD AND APPARATUS, AND TERMINAL

(71) Applicant: HUAWEI TECHNOLOGIES CO., LTD., Guangdong (CN)

(72) Inventor: Yangbo Lin, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 215 days.

(21) Appl. No.: 16/295,821

(22) Filed: Mar. 7, 2019

(65) Prior Publication Data

US 2019/0206237 A1 Jul. 4, 2019

Related U.S. Application Data

(63) Continuation of application No. PCT/CN2016/098565, filed on Sep. 9, 2016.

(51) Int. Cl.
*G08G 1/01* (2006.01)
*G08G 1/07* (2006.01)
(Continued)

(52) U.S. Cl.
CPC ..... *G08G 1/0145* (2013.01); *G08G 1/0112* (2013.01); *G08G 1/07* (2013.01);
(Continued)

(58) Field of Classification Search
CPC ..... G08G 1/0145; G08G 1/0112; G08G 1/07; G08G 1/087; G08G 1/163; G08G 1/164; G08G 1/166
See application file for complete search history.

(56) References Cited

U.S. PATENT DOCUMENTS 4,704,610 A 11/1987 Smith et al.
4,775,865 A 10/1988 Smith et al.
(Continued)

FOREIGN PATENT DOCUMENTS

AU 9756298 A 5/1999
BE 867721 A 10/1978
(Continued)

OTHER PUBLICATIONS

Extended European Search Report issued in European Application No. 16915492.9 dated Jul. 22, 2019, 9 pages.
(Continued)

*Primary Examiner* — Aniss Chad
*Assistant Examiner* — Madison R Hughes
(74) *Attorney, Agent, or Firm* — Fish & Richardson P.C.

(57) ABSTRACT

A vehicle right-of-way management method and apparatus, and a terminal. The method includes: determining a used right-of-way level of a first vehicle according to function information of the first vehicle, where the used right-of-way level of the first vehicle includes a right-of-way level that the management device allows the first vehicle to use; and scheduling a road resource for the first vehicle according to the used right-of-way level of the first vehicle. In technical solutions provided in embodiments of this application, the management device can allocate different used right-of-way levels to vehicles with different functions according to function information of the vehicles, and schedule and allocate road resources by means of overall planning for the vehicles in a transportation system according to the used right-of-way levels of the vehicles.

20 Claims, 8 Drawing Sheets

(51) Int. Cl.

| | |
|---|---|
| ***G08G 1/16*** | (2006.01) |
| ***G08G 1/087*** | (2006.01) |
| *G06Q 50/30* | (2012.01) |

(52) U.S. Cl.

CPC ..... *G08G 1/087* (2013.01); *G08G 1/163* (2013.01); *G08G 1/164* (2013.01); *G08G 1/166* (2013.01)

(56) References Cited

U.S. PATENT DOCUMENTS

| | | | | |
|---|---|---|---|---|
| 9,218,739 | B2 | 12/2015 | Trombley et al. | |
| 2009/0109061 | A1 | 4/2009 | McNew et al. | |
| 2014/0132422 | A1 | 5/2014 | Borland et al. | |
| 2014/0278029 | A1* | 9/2014 | Tonguz | G08G 1/087 701/117 |
| 2015/0286219 | A1 | 10/2015 | Reichel et al. | |
| 2016/0330036 | A1 | 11/2016 | Zhou et al. | |
| 2017/0154394 | A1* | 6/2017 | Kan | G06Q 10/0635 |
| 2017/0192438 | A1* | 7/2017 | Morimoto | G08G 1/161 |
| 2017/0276492 | A1* | 9/2017 | Ramasamy | B60W 40/04 |
| 2017/0301233 | A1* | 10/2017 | Witt | G08G 1/087 |
| 2017/0358025 | A1* | 12/2017 | Varma | G06Q 20/145 |
| 2018/0327029 | A1* | 11/2018 | Oooka | G08G 1/166 |

FOREIGN PATENT DOCUMENTS

| | | | |
|---|---|---|---|
| CA | 1252841 | A | 4/1989 |
| CN | 1855170 | A | 11/2006 |
| CN | 101042807 | A | 9/2007 |
| CN | 101082901 | A | 12/2007 |
| CN | 101218614 | A | 7/2008 |
| CN | 101842664 | A | 9/2010 |
| CN | 102285364 | A | 12/2011 |
| CN | 102306451 | A | 1/2012 |
| CN | 102368351 | A | 3/2012 |
| CN | 102542819 | A | 7/2012 |
| CN | 103065480 | A | 4/2013 |
| CN | 103500506 | A | 1/2014 |
| CN | 103593712 | A | 2/2014 |
| CN | 103973760 | A | 8/2014 |
| CN | 104123846 | A | 10/2014 |
| CN | 203931183 | U | 11/2014 |
| CN | 104245442 | A | 12/2014 |
| CN | 104299433 | A | 1/2015 |
| CN | 104485005 | A | 4/2015 |
| CN | 104574563 | A | 4/2015 |
| CN | 104575039 | A | 4/2015 |
| CN | 104658280 | A | 5/2015 |
| CN | 104780141 | A | 7/2015 |
| CN | 104867340 | A | 8/2015 |
| CN | 104882019 | A | 9/2015 |
| CN | 105070076 | A | 11/2015 |
| CN | 105094767 | A | 11/2015 |
| CN | 105321362 | A | 2/2016 |
| CN | 105739534 | A | 7/2016 |
| CN | 105788328 | A | 7/2016 |
| EP | 0461960 | A1 | 12/1991 |
| EP | 1933291 | A1 | 6/2008 |
| EP | 2205945 | A1 | 7/2010 |
| EP | 2858039 | A1 | 4/2015 |
| GB | 1604907 | A | 12/1981 |
| JP | 2008262418 | A | 10/2008 |
| JP | 2014222475 | A | 11/2014 |
| WO | 9923627 | A1 | 5/1999 |
| WO | 2014067638 | A3 | 9/2014 |
| WO | 2016086139 | A1 | 6/2016 |

OTHER PUBLICATIONS

International Search Report dated May 31, 2017 in corresponding International Application No. PCT/CN2016/098565.

International Search Report dated May 31, 2017 in corresponding International Patent Application No. PCT/CN2016/098565 (8 pages).

Written Opinion of the International Searching Authority dated May 31, 2017 in corresponding International Patent Application No. PCT/CN2016/098565 (6 pages).

Office Action issued in Japanese Application No. 2019-513433 dated Aug. 3, 2020, 13 pages (with English translation).

Office Action issued in Chinese Application No. 201680086901.4 dated Jan. 13, 2020, 48 pages (with English translation).

Viriyasitavat et al., "Priority Management of Emergency Vehicles at Intersections Using Self-Organized Traffic Control," 2012 IEEE Vehicular Technology Conference, Sep. 2012, 4 pages.

Wang et al., "Transit Signal Priority for Emergency Vehicle Based on Cooperative Vehicle Infrastructure System," The 7th China Intelligent Transportation Annual Conference, 2012, 8 pages (with English abstract).

Wen-min et al., "Algorithm research on traffic priority for emergency vehicles based on cooperative vehicle infrastructure system," Chinese Journal of Safety Science, Jul. 2015, 6 pages (with English abstract).

Liu Zupeng et al., "Research on Bus Priority Intelligent Signal Control System at an Intersection," Wuhan University of Science and Technology, Control Theory and Control Engineering, 2005, Master, 48 pages. (with English abstract).

Office Action issued in Chinese Application No. 201680086901.4 dated Oct. 12, 2020, 7 pages.

* cited by examiner

VEHICLE RIGHT-OF-WAY MANAGEMENT METHOD AND APPARATUS, AND TERMINAL

CROSS-REFERENCE TO RELATED APPLICATIONS

This application is a continuation of International Application No. PCT/CN2016/098565, filed on Sep. 9, 2016, the disclosure of which is hereby incorporated by reference in its entirety.

TECHNICAL FIELD

This application relates to the field of transportation system technologies, and in particular, to a vehicle right-of-way management method and apparatus, and a terminal.

BACKGROUND

An ITS (Intelligent Transportation System, intelligent transportation system) integrates and applies advanced technologies such as an information technology, a communications technology, a sensing technology, a control technology, a computer technology, so as to establish a real-time, accurate, efficient, and comprehensive transportation management system that plays an all-round role in a wide range. Main traffic participants in the ITS include a road infrastructure, a vehicle, a user, a management center, and the like. Vehicles are scheduled by the management center together, so that traffic facilities can be effectively used, traffic load and environmental pollution can be reduced, traffic safety can be ensured, and transportation efficiency can be improved, and these are a future development direction of the transportation system.

An essence of transportation is to transport a person or an object from one place to another place by using a road and a vehicle. Therefore, the road and the vehicle are most critical resources in the transportation system, and how to safely and effectively allocate a road resource to the vehicle becomes a key step in resolving a safety and efficiency problem in the transportation system.

However, in a process of implementing this application, it is found that vehicles in a conventional transportation system usually have a same road right over a road. Therefore, when a relatively large quantity of vehicles simultaneously use a same road, the road may be congested, and consequently, passing efficiency of the vehicles is reduced. Alternatively, when at least two vehicles contend for a lane at a same road segment, a traffic accident is likely to occur, and consequently, safety of the vehicles in the transportation system is affected.

SUMMARY

This application provides a vehicle right-of-way management method and apparatus, and a terminal, to resolve a problem of relatively low passing efficiency and safety of a vehicle in a transportation system.

According to a first aspect, an embodiment of this application provides a vehicle right-of-way management method applied to a management device, and the method includes: determining a used right-of-way level of a first vehicle according to function information of the first vehicle, where the used right-of-way level of the first vehicle includes a right-of-way level that the management device allows the first vehicle to use; and scheduling a road resource for the first vehicle according to the used right-of-way level of the first vehicle.

In this implementation, the management device may allocate different used right-of-way levels to vehicles with different functions according to function information of the vehicles, and schedule and allocate road resources by means of overall planning for the vehicles in a transportation system according to the used right-of-way levels of the vehicles, to improve safety and passing efficiency of the vehicles in the transportation system.

With reference to the first aspect, in a first possible implementation of the first aspect, after the determining a used right-of-way level of a first vehicle according to function information of the first vehicle, the method further includes: sending a right-of-way instruction message to the first vehicle, where the right-of-way instruction message includes the used right-of-way level of the first vehicle, and is used to instruct the first vehicle to use the used right-of-way level of the first vehicle.

In this implementation, the management device sends the used right-of-way level of the first vehicle to the first vehicle, so that the first vehicle uses the road resource according to the used right-of-way level of the first vehicle.

With reference to the first possible implementation of the first aspect, in a second possible implementation of the first aspect, before the sending a right-of-way instruction message to the first vehicle, the method further includes: receiving a right-of-way application message sent by the first vehicle, where the right-of-way application message is used to apply for the used right-of-way level of the first vehicle.

In this implementation, the management device sends the used right-of-way level of the first vehicle to the first vehicle only after receiving a request of the first vehicle, to avoid resource waste in the ITS.

With reference to the second possible implementation of the first aspect, in a third possible implementation of the first aspect, the right-of-way application message includes a right-of-way level for which the first vehicle applies, and is used to request to use the right-of-way level for which the first vehicle applies as the used right-of-way level of the first vehicle; and the determining a used right-of-way level of a first vehicle according to function information of the first vehicle includes: determining, according to the function information, a right-of-way level that matches the function information; and when there is an intersection set between the matched right-of-way level and the right-of-way level for which the first vehicle applies, using a right-of-way level in the intersection set as the used right-of-way level of the first vehicle; or otherwise, using the matched right-of-way level as the used right-of-way level of the first vehicle.

In this implementation, the function information is also used as a criterion for determining the used right-of-way level, but a right-of-way level for which a user applies is considered first, to improve user experience.

With reference to any one of the first aspect or the first to the third possible implementations of the first aspect, in a fourth possible implementation of the first aspect, the method further includes: updating the function information of the first vehicle to updated function information; and updating the used right-of-way level of the first vehicle to an updated used right-of-way level according to the updated function information.

In this implementation, the management device may correspondingly adjust a right-of-way level of a vehicle according to updated function information of the vehicle, to meet a requirement of the vehicle for a dynamically changing function.

With reference to the fourth possible implementation of the first aspect, in a fifth possible implementation of the first aspect, before the updating the function information of the first vehicle to updated function information, the method further includes: receiving a function update application message sent by the first vehicle, where the function update application message includes the updated function information for which the first vehicle applies; and updating, only when the first vehicle is allowed to apply for updating the function information, the function information of the first vehicle to the updated function information for which the first vehicle applies.

In this implementation, the management device may selectively update function information of a vehicle in a manner in which the vehicle makes a request and the management device performs examination, to improve safety in the ITS while meeting a vehicle requirement.

With reference to the fourth possible implementation of the first aspect, in a sixth possible implementation of the first aspect, before the updating the function information of the first vehicle to updated function information, the method includes: receiving a function update instruction message that is sent by a third-party entity and that includes the updated function information, where the function update instruction message is used to instruct to update the function information of the first vehicle to the updated function information, and a user of the third-party entity has permission for updating the function information of the first vehicle.

In this implementation, the management device may update function information of a vehicle based on an instruction message sent by the third-party entity, to improve vehicle right-of-way management flexibility and extensibility.

With reference to any one of the first aspect or the first to the sixth possible implementations of the first aspect, in a seventh possible implementation of the first aspect, the scheduling a road resource for the first vehicle according to the used right-of-way level of the first vehicle includes: obtaining a mapping relationship between a road in a transportation system and a right-of-way level of a vehicle, where the mapping relationship is static or dynamically changes; and determining an available-road set of the first vehicle according to the mapping relationship and the used right-of-way level of the first vehicle.

In this implementation, the management device may actively schedule a road resource for a vehicle according to a used right-of-way level of the vehicle.

With reference to the seventh possible implementation of the first aspect, in an eighth possible implementation of the first aspect, the method further includes: receiving a road use application message that is sent by the first vehicle and that includes at least one of time constraint information or space constraint information; selecting a road that matches at least one of the time constraint information or the space constraint information from the available-road set as an allocated road; and sending a road use allocation message that includes information about the allocated road to the first vehicle.

In this implementation, the management device schedules a road resource for a vehicle according to a right-of-way level of the vehicle and a road constraint condition, to meet a road resource scheduling requirement of a user.

With reference to any one of the first aspect or the first to the sixth possible implementations of the first aspect, in a ninth possible implementation of the first aspect, the scheduling a road resource for the first vehicle according to the used right-of-way level of the first vehicle includes: determining, according to the used right-of-way level of the first vehicle, a road to be allocated to the first vehicle for use; and when the road to be allocated to the first vehicle for use has been allocated to a second vehicle for use, and there is a conflict between the first vehicle and the second vehicle over use of the road, if the used right-of-way level of the first vehicle is higher than a used right-of-way level of the second vehicle, first scheduling the road for the first vehicle for use; or otherwise, later scheduling the road for the first vehicle for use, or scheduling another road for the first vehicle for use.

In this implementation, when there is a conflict between different vehicles over use of a same road, a management center properly allocates road resources to the vehicles, so that not only safety of the vehicles can be ensured, but also passing efficiency of the vehicles can be improved.

With reference to any one of the first aspect or the first to the sixth possible implementations of the first aspect, in a tenth possible implementation of the first aspect, the scheduling a road resource for the first vehicle according to the used right-of-way level of the first vehicle includes: receiving a road use priority application message sent by the first vehicle, where the road use priority application message is used to apply for a higher priority of using a road than a second vehicle; and sending a road use priority examination message to the first vehicle, where if the used right-of-way level of the first vehicle is higher than a used right-of-way level of the second vehicle, the road use priority examination message indicates that the first vehicle has a higher priority of using the road than the second vehicle; or otherwise, the road use priority examination message indicates that the first vehicle is rejected to have a higher priority of using the road than the second vehicle.

With reference to the first aspect, in an eleventh possible implementation of the first aspect, the method further includes: receiving a right-of-way notification message sent by the first vehicle, or receiving the right-of-way notification message after sending a right-of-way query message to the first vehicle, where the right-of-way notification message includes the used right-of-way level of the first vehicle.

According to a second aspect, an embodiment of this application further provides another vehicle right-of-way management method applied to a first vehicle, and the method includes: receiving a right-of-way instruction message sent by a management device, where the right-of-way instruction message includes a used right-of-way level of the first vehicle, and is used to instruct the first vehicle to use the used right-of-way level of the first vehicle, and the used right-of-way level of the first vehicle is determined by the management device according to function information of the first vehicle; and using a road resource according to the used right-of-way level of the first vehicle, or using a road resource that is scheduled by the management device according to the used right-of-way level of the first vehicle.

With reference to the second aspect, in a first possible implementation of the second aspect, before the receiving the right-of-way instruction message sent by the management device, the method further includes: sending a right-of-way application message to the management device, where the right-of-way application message is used to apply for the used right-of-way level of the first vehicle.

With reference to the first possible implementation of the second aspect, in a second possible implementation of the second aspect, the right-of-way application message includes a right-of-way level for which the first vehicle applies, and is used to request to use the right-of-way level for which the first vehicle applies as the used right-of-way level of the first vehicle.

With reference to the second aspect, in a third possible implementation of the second aspect, the method further includes: sending a function update application message to the management device, where the function update application message is used to instruct the management device to update the function information of the first vehicle to updated function information, and the function update application message includes the updated function information.

With reference to the second aspect, in a fourth possible implementation of the second aspect, the using a road resource that is scheduled by the management device according to the used right-of-way level of the first vehicle includes: sending a road use application message that includes at least one of time constraint information or space constraint information to the management device; and receiving a road use allocation message that is sent by the management device and that includes information about an allocated road, where the allocated road matches the used right-of-way level of the first vehicle and at least one of the time constraint information or the space constraint information.

With reference to the second aspect, in a fifth possible implementation of the second aspect, the using a road resource according to the used right-of-way level of the first vehicle includes: when a road to be used by the first vehicle is being used by a second vehicle, and there is a conflict between the first vehicle and the second vehicle over use of the road, sending a road use priority application message to the management device or the second vehicle, where the road use priority application message sent to the second vehicle includes the used right-of-way level of the first vehicle; and receiving a road use priority examination message sent by the management device or the second vehicle, where if the used right-of-way level of the first vehicle is higher than a used right-of-way level of the second vehicle, the road use priority examination message indicates that the first vehicle has a higher priority of using the road than the second vehicle; or otherwise, the road use priority examination message indicates that the first vehicle is rejected to have a higher priority of using the road than the second vehicle.

With reference to the second aspect, in a sixth possible implementation of the second aspect, the using a road resource according to the used right-of-way level of the first vehicle includes: receiving a road use priority notification message sent by the management device, where the road use priority notification message indicates that the management device allows a second vehicle to have a higher priority of using a road than the first vehicle; and preferentially meeting use of the road by the second vehicle.

With reference to the second aspect, in a seventh possible implementation of the second aspect, the using a road resource according to the used right-of-way level of the first vehicle includes: when a road to be used by the first vehicle is being used by a second vehicle, and there is a conflict between the first vehicle and the second vehicle over use of the road, obtaining, by the first vehicle, a used right-of-way level of the second vehicle; and when the used right-of-way level of the second vehicle is higher than the used right-of-way level of the first vehicle, preferentially meeting use of the road by the second vehicle.

With reference to the second aspect, in an eighth possible implementation of the second aspect, the method further includes: sending a right-of-way notification message to another traffic participating entity in a transportation system, or sending the right-of-way notification message to the another traffic participating entity in the transportation system after receiving a right-of-way query message sent by the another traffic participating entity, where the right-of-way notification message includes the used right-of-way level of the first vehicle.

With reference to the second aspect, in a ninth possible implementation of the second aspect, the using a road resource according to the used right-of-way level of the first vehicle includes: obtaining a mapping relationship between a road in a transportation system and a right-of-way level of a vehicle, where the mapping relationship is static or dynamically changes; determining an available-road set of the first vehicle according to the mapping relationship and the used right-of-way level of the first vehicle; and using a road in the available-road set.

With reference to the second aspect, in a tenth possible implementation of the second aspect, a mapping relationship is statically or dynamically set between a road in a transportation system and a right-of-way level of a vehicle, and the using a road resource according to the used right-of-way level of the first vehicle includes: receiving a right-of-way alarm message sent by the another traffic participating entity in the transportation system, where the right-of-way alarm message is used to indicate that the used right-of-way level of the first vehicle does not match a road for which the first vehicle applies for use or a road that is being used by the first vehicle.

With reference to the eighth or the tenth possible implementation of the second aspect, in an eleventh possible implementation of the second aspect, the another traffic participating entity in the transportation system includes a second vehicle, the management device, or a roadside infrastructure in the transportation system.

According to a third aspect, an embodiment of this application further provides a vehicle right-of-way management apparatus applied to a management device, and the apparatus includes: a used right-of-way level determining module, configured to determine a used right-of-way level of a first vehicle according to function information of the first vehicle, where the used right-of-way level of the first vehicle includes a right-of-way level that the management device allows the first vehicle to use; and a road resource scheduling module, configured to schedule a road resource for the first vehicle according to the used right-of-way level of the first vehicle.

With reference to the third aspect, in a first possible implementation of the third aspect, the apparatus further includes a right-of-way instruction message sending module, configured to send a right-of-way instruction message to the first vehicle, where the right-of-way instruction message includes the used right-of-way level of the first vehicle, and is used to instruct the first vehicle to use the used right-of-way level of the first vehicle.

With reference to the first possible implementation of the third aspect, in a second possible implementation of the third aspect, the apparatus further includes a right-of-way application message receiving module, configured to receive a right-of-way application message sent by the first vehicle, where the right-of-way application message is used to apply for the used right-of-way level of the first vehicle.

With reference to the second possible implementation of the third aspect, in a third possible implementation of the third aspect, the right-of-way application message includes a right-of-way level for which the first vehicle applies, and is used to request to use the right-of-way level for which the first vehicle applies as the used right-of-way level of the first vehicle, and the used right-of-way level determining module further includes: a matched right-of-way level determining submodule, configured to determine, according to the function information, a right-of-way level that matches the function information; and a used right-of-way level determining submodule, configured to: when there is an intersection set between the matched right-of-way level and the right-of-way level for which the first vehicle applies, use a right-of-way level in the intersection set as the used right-of-way level of the first vehicle; or otherwise, use the matched right-of-way level as the used right-of-way level of the first vehicle.

With reference to any one of the third aspect or the first to the third possible implementations of the third aspect, in a fourth possible implementation of the third aspect, the apparatus further includes: a function information update module, configured to update the function information of the first vehicle to updated function information; and a used right-of-way level update module, configured to update the used right-of-way level of the first vehicle to an updated used right-of-way level according to the updated function information.

With reference to the fourth possible implementation of the third aspect, in a fifth possible implementation of the third aspect, the apparatus further includes: a function update application message receiving module, configured to receive a function update application message sent by the first vehicle, where the function update application message includes the updated function information for which the first vehicle applies; and a function information update determining module, configured to update, only when it is determined that the first vehicle is allowed to apply for updating the function information, the function information of the first vehicle to the updated function information for which the first vehicle applies.

With reference to the fourth possible implementation of the third aspect, in a sixth possible implementation of the third aspect, the apparatus further includes a function update instruction message receiving module, configured to receive a function update instruction message that is sent by a third-party entity and that includes the updated function information, where the function update instruction message is used to instruct to update the function information of the first vehicle to the updated function information, and a user of the third-party entity has permission for updating the function information of the first vehicle.

With reference to any one of the third aspect or the first to the sixth possible implementations of the third aspect, in a seventh possible implementation of the third aspect, the road resource scheduling module includes: a mapping relationship obtaining module, configured to obtain a mapping relationship between a road in a transportation system and a right-of-way level of a vehicle, where the mapping relationship is static or dynamically changes; and an available-road set determining module, configured to determine an available-road set of the first vehicle according to the mapping relationship and the used right-of-way level of the first vehicle.

With reference to the seventh possible implementation of the third aspect, in an eighth possible implementation of the third aspect, the apparatus further includes: a road use application message receiving module, configured to receive a road use application message that is sent by the first vehicle and that includes at least one of time constraint information or space constraint information; an allocated-road selection module, configured to select a road that matches at least one of the time constraint information or the space constraint information from the available-road set as an allocated road; and a road use allocation message sending module, configured to send a road use allocation message that includes information about the allocated road to the first vehicle.

With reference to any one of the third aspect or the first to the sixth possible implementations of the third aspect, in a ninth possible implementation of the third aspect, the road resource scheduling module includes: a to-be-allocated road determining submodule, configured to determine, according to the used right-of-way level of the first vehicle, a road to be allocated to the first vehicle for use; and a road scheduling submodule, configured to: when the road to be allocated to the first vehicle for use has been allocated to a second vehicle for use, and there is a conflict between the first vehicle and the second vehicle over use of the road, if the used right-of-way level of the first vehicle is higher than a used right-of-way level of the second vehicle, first schedule the road for the first vehicle for use; or otherwise, later schedule the road for the first vehicle for use, or schedule another road for the first vehicle for use.

With reference to any one of the third aspect or the first to the sixth possible implementations of the third aspect, in a tenth possible implementation of the third aspect, the road resource scheduling module includes: a road use priority application message receiving submodule, configured to receive a road use priority application message sent by the first vehicle, where the road use priority application message is used to apply for a higher priority of using a road than a second vehicle; and a road use priority examination message sending submodule, configured to send a road use priority examination message to the first vehicle, where if the used right-of-way level of the first vehicle is higher than a used right-of-way level of the second vehicle, the road use priority examination message indicates that the first vehicle has a higher priority of using the road than the second vehicle; or otherwise, the road use priority examination message indicates that the first vehicle is rejected to have a higher priority of using the road than the second vehicle.

With reference to the third aspect, in an eleventh possible implementation of the third aspect, the apparatus further includes a first right-of-way notification message transceiver module, configured to: receive a right-of-way notification message sent by the first vehicle, or receive the right-of-way notification message after sending a right-of-way query message to the first vehicle, where the right-of-way notification message includes the used right-of-way level of the first vehicle.

According to a fourth aspect, an embodiment of this application further provides a vehicle right-of-way management apparatus applied to a first vehicle, and the apparatus includes: a right-of-way instruction message receiving module, configured to receive a right-of-way instruction message sent by a management device, where the right-of-way instruction message includes a used right-of-way level of the first vehicle, and is used to instruct the first vehicle to use the used right-of-way level of the first vehicle, and the used right-of-way level of the first vehicle is determined by the management device according to function information of the first vehicle; and a first road resource use module, configured to use a road resource according to the used right-of-way level of the first vehicle; or a second road resource use module, configured to use a road resource that is scheduled by the management device according to the used right-of-way level of the first vehicle.

With reference to the fourth aspect, in a first possible implementation of the fourth aspect, the apparatus further includes a right-of-way application message sending module, configured to send a right-of-way application message to the management device, where the right-of-way application message is used to apply for the used right-of-way level of the first vehicle.

With reference to the first possible implementation of the fourth aspect, in a second possible implementation of the fourth aspect, the right-of-way application message includes a right-of-way level for which the first vehicle applies, and is used to request to use the right-of-way level for which the first vehicle applies as the used right-of-way level of the first vehicle.

With reference to the fourth aspect, in a third possible implementation of the fourth aspect, the apparatus further includes a function update application message sending module, configured to send a function update application message to the management device, where the function update application message is used to instruct the management device to update the function information of the first vehicle to updated function information, and the function update application message includes the updated function information.

With reference to the fourth aspect, in a fourth possible implementation of the fourth aspect, the second road resource use module includes: a road use application message sending submodule, configured to send a road use application message that includes at least one of time constraint information or space constraint information to the management device; and a road use allocation message receiving submodule, configured to receive a road use allocation message that is sent by the management device and that includes information about an allocated road, where the allocated road matches the used right-of-way level of the first vehicle and at least one of the time constraint information or the space constraint information.

With reference to the fourth aspect, in a fifth possible implementation of the fourth aspect, the first road resource use module includes: a road use priority application message sending submodule, configured to: when a road to be used by the first vehicle is being used by a second vehicle, and there is a conflict between the first vehicle and the second vehicle over use of the road, send a road use priority application message to the management device or the second vehicle, where the road use priority application message sent to the second vehicle includes the used right-of-way level of the first vehicle; and a road use priority examination message receiving submodule, configured to receive a road use priority examination message sent by the management device or the second vehicle, where if the used right-of-way level of the first vehicle is higher than a used right-of-way level of the second vehicle, the road use priority examination message indicates that the first vehicle has a higher priority of using the road than the second vehicle; or otherwise, the road use priority examination message indicates that the first vehicle is rejected to have a higher priority of using the road than the second vehicle.

With reference to the fourth aspect, in a sixth possible implementation of the fourth aspect, the first road resource use module includes: a road use priority notification message receiving submodule, configured to receive a road use priority notification message sent by the management device, where the road use priority notification message indicates that the management device allows a second vehicle to have a higher priority of using a road than the first vehicle; and a first road use priority execution submodule, configured to preferentially meet use of the road by the second vehicle.

With reference to the fourth aspect, in a seventh possible implementation of the fourth aspect, the first road resource use module includes: a used right-of-way level obtaining submodule, configured to: when a road to be used by the first vehicle is being used by a second vehicle, and there is a conflict between the first vehicle and the second vehicle over use of the road, obtain a used right-of-way level of the second vehicle; and a second road use priority execution submodule, configured to: when the used right-of-way level of the second vehicle is higher than the used right-of-way level of the first vehicle, preferentially meet use of the road by the second vehicle.

With reference to the fourth aspect, in an eighth possible implementation of the fourth aspect, the apparatus further includes a second right-of-way notification message transceiver module, configured to: send a right-of-way notification message to another traffic participating entity in a transportation system, or send the right-of-way notification message to the another traffic participating entity in the transportation system after receiving a right-of-way query message sent by the another traffic participating entity, where the right-of-way notification message includes the used right-of-way level of the first vehicle.

With reference to the fourth aspect, in a ninth possible implementation of the fourth aspect, the first road resource use module includes: a mapping relationship obtaining submodule, configured to obtain a mapping relationship between a road in a transportation system and a right-of-way level of a vehicle, where the mapping relationship is static or dynamically changes; an available-road set determining submodule, configured to determine an available-road set of the first vehicle according to the mapping relationship and the used right-of-way level of the first vehicle; and a road use execution submodule, configured to use a road in the available-road set.

With reference to the fourth aspect, in a tenth possible implementation of the fourth aspect, a mapping relationship is statically or dynamically set between a road in a transportation system and a right-of-way level of a vehicle, and the first road resource use module includes a right-of-way alarm message receiving submodule, configured to receive a right-of-way alarm message sent by the another traffic participating entity in the transportation system, where the right-of-way alarm message is used to indicate that the used right-of-way level of the first vehicle does not match a road for which the first vehicle applies for use or a road that is being used by the first vehicle.

With reference to the eighth or the tenth possible implementation of the fourth aspect, in an eleventh possible implementation of the fourth aspect, the another traffic participating entity in the transportation system includes a second vehicle, the management device, or a roadside infrastructure in the transportation system.

According to a fifth aspect, an embodiment of this application further provides a management device, and the management device includes: a processor, and a memory configured to store an execution instruction of the processor, where the processor is configured to perform the method according to any one of the first aspect or the possible implementations of the first aspect.

According to a sixth aspect, an embodiment of this application further provides a vehicle, and the vehicle includes: a processor, and a memory configured to store an execution instruction of the processor, where the processor is configured to perform the method according to any one of the second aspect or the possible implementations of the second aspect.

In the technical solutions provided in the embodiments of this application, the management device can allocate different used right-of-way levels to vehicles with different functions according to function information of the vehicles, and schedule and allocate road resources by means of overall planning for the vehicles in the transportation system according to the used right-of-way levels of the vehicles, to improve safety and passing efficiency of the vehicles in the transportation system.

BRIEF DESCRIPTION OF DRAWINGS

To describe the technical solutions in the embodiments of this application more clearly, the following briefly describes the accompanying drawings required for describing the embodiments.

DESCRIPTION OF EMBODIMENTS

To make a person skilled in the art understand the technical solutions in this application better, the following clearly describes the technical solutions in the embodiments of this application with reference to the accompanying drawings in the embodiments of this application.

For ease of description, in the embodiments of this application, an intelligent transportation system ITS is used as an application environment of a vehicle right-of-way management solution provided in the embodiments of this application. However, it should be understood that a person skilled in the art may apply the right-of-way management solution provided in the embodiments of this application to another type of transportation system, which shall fall within the protection scope of this application.

Traffic participating entities in the ITS in the embodiments of this application may include a vehicle, a management center, and a roadside infrastructure. Quantities and representation forms of vehicles, management centers, and roadside infrastructures are not limited in the embodiments of this application. For example, the vehicle in the embodiments of this application may include an ambulance, a taxi, a private car, or the like.

The vehicle in the embodiments of this application may be a vehicle that has a wireless communication function, or may be a vehicle that carries a wireless communications device. The wireless communications device may include various handheld devices, in-vehicle devices, computer devices, or wearable devices that have a wireless communication function, or user equipment in various forms.

The roadside infrastructure in the embodiments of this application is an intelligent device that has a wireless communication function, or may be an infrastructure in which a wireless communications device is disposed, so that the roadside infrastructure can exchange information with another traffic participating entity in the ITS.

The management center in the embodiments of this application is a specific place in which a management device is disposed. The management device may be a computer device that has functions of communication, storage, and data processing, and is a control center in the ITS. Both the management device and the management center in the embodiments of this application can represent the control center in the ITS.

Figure 1:
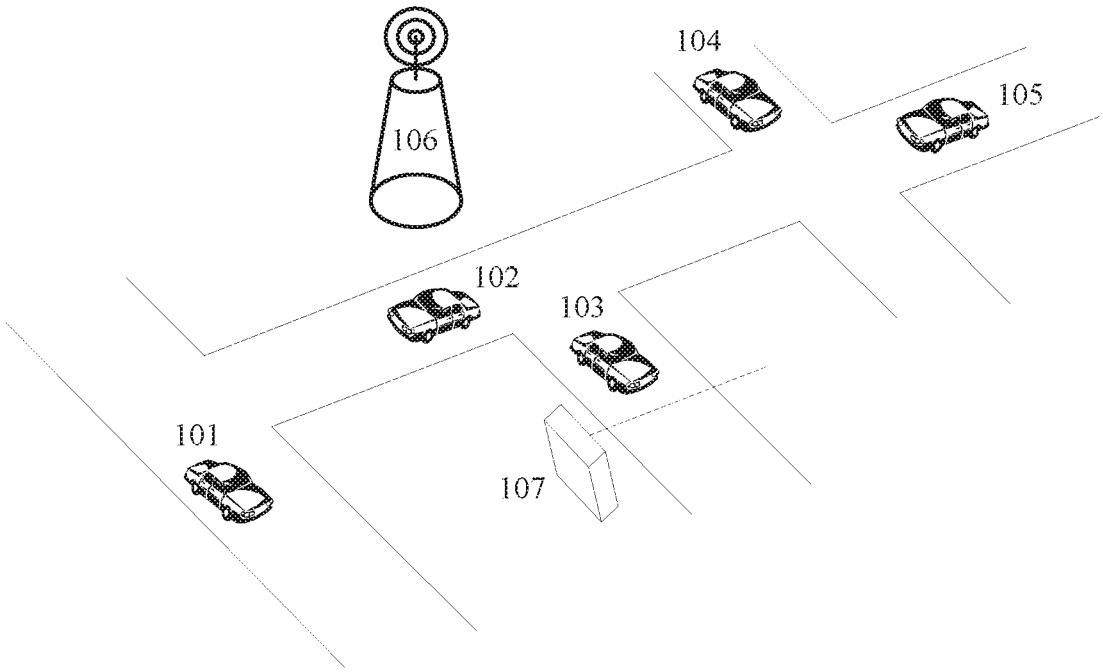
FIG. 1 is a schematic scenario diagram of an ITS according to an embodiment of this application.

Referring to FIG. 1, FIG. 1 is a schematic scenario diagram of an ITS according to an embodiment of this application.

In the ITS shown in FIG. 1, traffic participating entities include vehicles 101 to 105, a management center 106, and a roadside infrastructure 107. The traffic participating entities are connected by using a network, and can not only directly exchange information with each other, but also indirectly exchange information with each other. For example, a vehicle can directly exchange information with the management center 106, a vehicle can directly exchange information with the roadside infrastructure 107, the management center 106 can directly exchange information with the roadside infrastructure 107, and two vehicles can directly exchange information. Alternatively, a vehicle can indirectly exchange information with the roadside infrastructure 107 by using the management center 106, and two vehicles can indirectly exchange information by using the management center 106.

Figure 2:
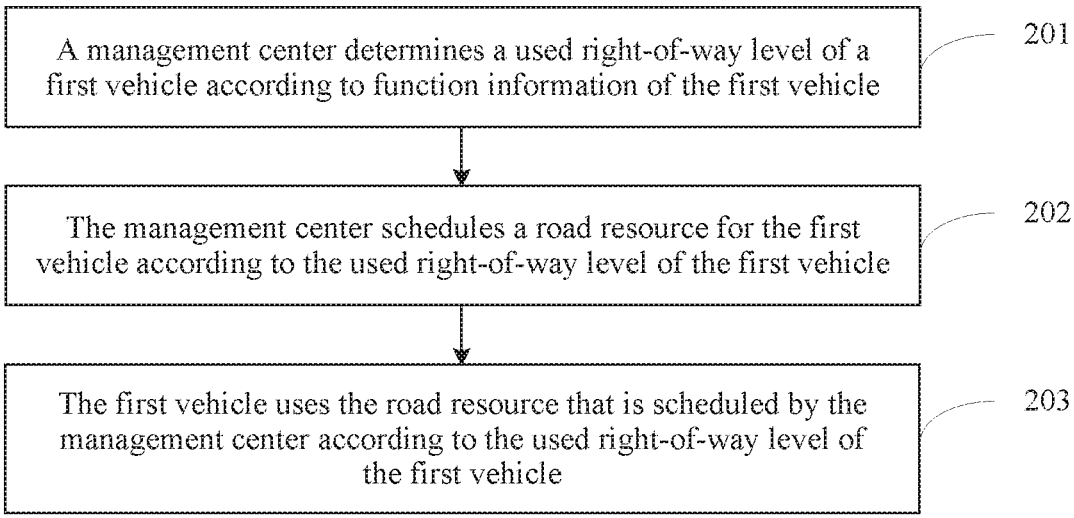
FIG. 2 is a schematic flowchart of a vehicle right-of-way management method according to an embodiment of this application.

Referring to FIG. 2, FIG. 2 is a schematic flowchart of a vehicle right-of-way management method according to an embodiment of this application. Because a vehicle and a management center are main participants in vehicle right-of-way management, the method may be applied to a vehicle or a management center in an ITS, or a communications system including a vehicle and a management center. The method mainly includes the following steps.

Step 201: The management center determines a used right-of-way level of a first vehicle according to function information of the first vehicle.

To improve safety and passing efficiency of a vehicle in the ITS, a corresponding right-of-way usually needs to be allocated to the vehicle. The right-of-way is a right of traveling in specific space and a specific time by a vehicle. Further, the right-of-way may include a passing right and a passing priority. The passing right is a right of traveling in a specific space range by a vehicle, for example, a motor vehicle has a passing right on a motorway, and does not have a passing right on a non-motorway. The passing priority is a relative concept, and means that a vehicle has a right of traveling first relative to an object compared with the vehicle, for example, at an intersection, a going-straight vehicle has a passing priority relative to a turning vehicle.

In the ITS, a road use right grade of a vehicle may be limited by setting a right-of-way level, to confine the vehicle to traveling in space and a time allowed by the right-of-way level of the vehicle, so that a road resource can be allocated.

Generally, road use right grades of vehicles are divided based on functions of the vehicles. For example, the road use right grades of the vehicles may be sequentially divided into a special vehicle level, a public vehicle level, a dedicated vehicle level, and the like in descending order of the functions of the vehicles. The special vehicle level is corresponding to a vehicle that has a special function, for example, an ambulance or a fire engine. The public vehicle level is corresponding to a vehicle that has a public function, for example, a bus or a school bus. The dedicated vehicle level is corresponding to a vehicle that has a dedicated function, for example, a private car or a taxi.

In this embodiment of this application, the right-of-way level is used to identify the road use right grade of the vehicle, and a mapping relationship between a right-of-way level and a vehicle function is established, so that when the vehicle function changes, a used right-of-way level of the vehicle is correspondingly adjusted according to the mapping relationship between a right-of-way level and a vehicle function. Therefore, when the vehicle function dynamically changes, the used right-of-way level of the vehicle is adaptively adjusted.

There are a relatively large quantity of vehicles in a transportation system. To fairly and effectively allocate rights-of-way to all vehicles in the transportation system, the management center usually needs to determine used right-of-way levels of the vehicles according to function information of the vehicles. The used right-of-way level is a right-of-way level that the management center allows the vehicle to use. The management center may store the function information of the vehicles, or may exchange information with another functional entity to obtain the function information of the vehicles. For example, the management center may query a vehicle manufacturer, a vehicle management organization, or the vehicles for the function information of the vehicles.

It should be noted that the right-of-way level is a parameter used to identify the road use right grade of the vehicle, and a data type of the right-of-way level is not limited in this application. For example, the data type of the right-of-way level may be an integer type or an enumerated type. In a possible implementation of this application, a correspondence between a right-of-way level and a vehicle function is shown in Table 1.

TABLE 1

| | Right-of-way level Integer type | | |
|---|---|---|---|
| | 2 | 1 | 0 |
| | Enumerated type | | |
| | Special | Public | Dedicated |
| Vehicle function | Ambulance, fire engine, or the like | Bus, school bus, or the like | Private car, taxi, or the like |

In Table 1, priorities of right-of-way levels of the integer type are "2">"1">"0", and priorities of right-of-way levels of the enumerated type are "special">"public">"dedicated". A right-of-way level of the integer type and a right-of-way level of the enumerated type in a same column have different representation forms, but a road use right grade identified by the right-of-way level of the integer type and a road use right grade identified by the right-of-way level of the enumerated type are the same. For example, both a road use right grade identified by a right-of-way level "2" of the integer type and a road use right grade identified by a right-of-way level "special" of the enumerated type are the special vehicle level. For ease of description, the right-of-way level of the integer type is used below to describe the technical solutions in this application, but this should not be understood as a limitation to the protection scope of this application.

In this embodiment of this application, because there is a definite mapping relationship between a right-of-way level and a vehicle function, the management center may determine a used right-of-way level of a vehicle according to a vehicle function. For example (according to the mapping relationship in Table 1), when a function of the first vehicle is an ambulance, the management center determines that the used right-of-way level of the first vehicle is "2"; when a function of the first vehicle is a bus, the management center determines that the used right-of-way level of the first vehicle is "1"; and when a function of the first vehicle is a private car, the management center determines that the used right-of-way level of the first vehicle is "0".

Step 202: The management center schedules a road resource for the first vehicle according to the used right-of-way level of the first vehicle.

After determining the used right-of-way level, the management center may schedule the road resource according to the used right-of-way level in multiple manners. For example, the management center determines an available-road set of the first vehicle according to the used right-of-way level of the first vehicle; the management center plans a path for the first vehicle according to the used right-of-way level of the first vehicle and road constraint information; or the management center examines a road use priority according to the used right-of-way level of the first vehicle and a used right-of-way level of a second vehicle. A specific implementation of scheduling the road resource for the first vehicle by the management center is described below in detail.

Step 203: The first vehicle uses the road resource that is scheduled by the management center according to the used right-of-way level of the first vehicle.

After scheduling the road resource for the first vehicle, the management center may send information about the scheduled road resource to the first vehicle, and the first vehicle travels in the ITS according to the information about the scheduled road resource.

For example, the management center sends information about the available-road set of the first vehicle to the first vehicle, and the first vehicle chooses to travel on a road in the available-road set; the management center sends path planning information of the first vehicle to the first vehicle, and the first vehicle travels on a path in the path planning information; or the management center sends road use priority examination information to the first vehicle, and the first vehicle determines whether to preferentially use a road according to the road use priority examination information.

In the technical solution provided in this embodiment of this application, the management center can allocate different used right-of-way levels to vehicles with different functions according to function information of the vehicles, and schedule and allocate road resources by means of overall planning for the vehicles in the transportation system according to the used right-of-way levels of the vehicles, to improve safety and passing efficiency of the vehicles in the transportation system.

In the foregoing technical solution, the management center may actively allocate the used right-of-way level to the first vehicle according to the function information of the first vehicle. In a possible implementation of this application, the management center may allocate the used right-of-way level to the vehicle based on a request of the vehicle. That is, the first vehicle first sends a right-of-way application message to the management center, and the management center allocates the used right-of-way level to the first vehicle only after receiving the right-of-way application message.

In addition, to improve user experience, alternatively, the management center may allocate the used right-of-way level to the first vehicle according to a user requirement. The right-of-way application message may include a right-of-way level for which the first vehicle applies. The right-of-way level for which the first vehicle applies is a right-of-way level that the first vehicle requests to use. For example, when the first vehicle carries a patient that requires emergency treatment, to quickly arrive at a hospital, the first vehicle may request to use a right-of-way level "2" as the used right-of-way level of the first vehicle, that is, the right-of-way level for which the first vehicle applies is "2".

After receiving the right-of-way application message that includes the right-of-way level for which the first vehicle applies, the management center needs to examine, according to the function information of the first vehicle, validity of the right-of-way level for which the first vehicle applies, to determine whether to allow the first vehicle to use the right-of-way level for which the first vehicle applies.

The management center determines, according to the function information of the first vehicle, a right-of-way level that matches the function information of the first vehicle. For example, if the function information of the first vehicle indicates that the first vehicle is an ambulance, it may be learned from Table 1 that a right-of-way level that matches the ambulance is "2". Certainly, a person skilled in the art may use all right-of-way levels less than or equal to "2" as right-of-way levels that match the ambulance, that is, the right-of-way levels that match the ambulance are "2", "1", and When there is an intersection set between the matched right-of-way level and the right-of-way level for which the first vehicle applies, a right-of-way level in the intersection set is used as the used right-of-way level of the first vehicle. Otherwise, the matched right-of-way level is used as the used right-of-way level of the first vehicle. For example, if the right-of-way level for which the first vehicle applies is "2", and the matched right-of-way levels are "2", "1", and "0", the right-of-way level "2" is used as the used right-of-way level of the first vehicle; and if the right-of-way level for which the first vehicle applies is "2", and the matched right-of-way levels are "1" and "0", one right-of-way level is selected from the right-of-way levels "1" and "0" as the used right-of-way level of the first vehicle.

In the technical solution provided in this embodiment of this application, the function information is also used as a criterion for determining the used right-of-way level, but a right-of-way level for which a user applies is considered first, to improve user experience.

Figure 3:
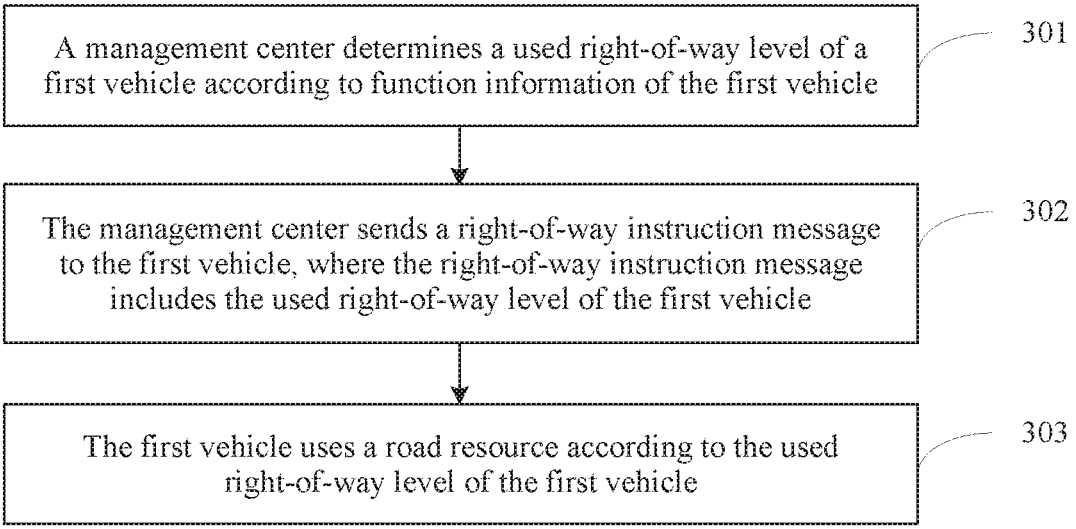
FIG. 3 is a schematic flowchart of another vehicle right-of-way management method according to an embodiment of this application.

Referring to FIG. 3, FIG. 3 is a schematic flowchart of another vehicle right-of-way management method according to an embodiment of this application. The method may also be applied to a vehicle or a management center in an ITS, or a communications system including a vehicle and a management center. The method mainly includes the following steps.

Step 301: The management center determines a used right-of-way level of a first vehicle according to function information of the first vehicle.

A manner of determining the used right-of-way level of the first vehicle by the management center is similar to step 201 in the embodiment shown in FIG. 2. For related content, refer to step 201. For brevity, details are not described herein in this embodiment of this application.

Step 302: The management center sends a right-of-way instruction message to the first vehicle, where the right-of-way instruction message includes the used right-of-way level of the first vehicle.

After determining the used right-of-way level of the first vehicle, the management center sends the used right-of-way level of the first vehicle to the first vehicle by using the right-of-way instruction message, so that the first vehicle obtains a right-of-way level that the management center allows the first vehicle to use. For example, if the management center determines that the used right-of-way level of the first vehicle is "2", the management center sends the right-of-way instruction message that includes the parameter "2" to the first vehicle, and the first vehicle obtains the right-of-way level "2" that the management center allows the first vehicle to use.

Step 303: The first vehicle uses a road resource according to the used right-of-way level of the first vehicle.

A used right-of-way level is a right grade identifier of a vehicle in the ITS. After obtaining the used right-of-way level of the vehicle, the vehicle may use a road resource according to the used right-of-way level of the vehicle. For example, when a road to be used by the first vehicle is being used by a second vehicle, and there is a conflict between the first vehicle and the second vehicle over use of the road (there being the conflict is described below in detail), a road use priority application message is sent to the management center or the second vehicle, and the management center or the second vehicle determines, according to the used right-of-way level of the first vehicle and a used right-of-way level of the second vehicle, whether the first vehicle can preferentially use the road. When a road to be used by the first vehicle is being used by a second vehicle, and there is a conflict between the first vehicle and the second vehicle over use of the road, the first vehicle obtains a used right-of-way level of the second vehicle, and when the used right-of-way level of the second vehicle is higher than the used right-of-way level of the first vehicle, use of the road by the second vehicle is preferentially met, that is, the first vehicle actively gives way to the second vehicle. Alternatively, a mapping relationship is set between a road and a right-of-way level, and after obtaining the used right-of-way level of the first vehicle, the first vehicle may determine, according to the mapping relationship and the used right-of-way level of the first vehicle, a road that can be used by the first vehicle. A specific implementation in which the vehicle uses the road resource according to the used right-of-way level of the vehicle is described below in detail.

In the technical solution provided in this embodiment of this application, a vehicle may independently determine, according to a used right-of-way level allocated by the management center, a road resource that can be used by the vehicle, so that vehicle right-of-way management flexibility in the ITS is improved.

In addition, in the ITS, a vehicle function may change. The used right-of-way level of the vehicle is allocated by the management center according to function information of the vehicle. Therefore, when the function information of the vehicle changes, the management center needs to re-determine the used right-of-way level of the vehicle for the vehicle according to new function information.

Figure 4:
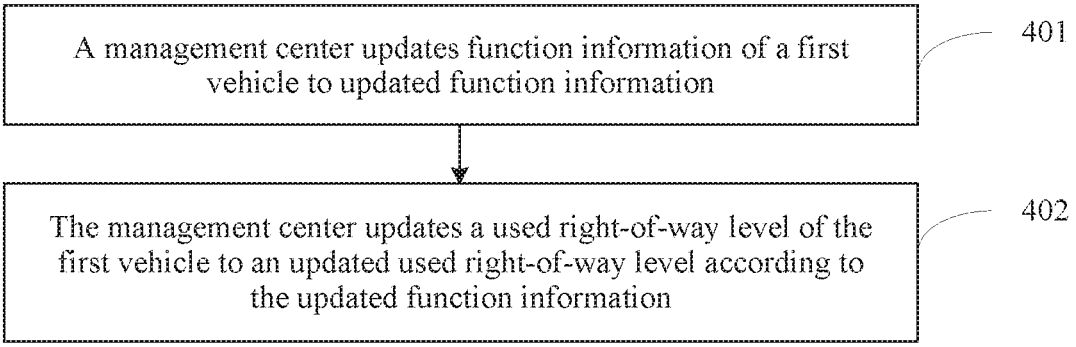
FIG. 4 is a schematic flowchart of a method for updating a used right-of-way level according to an embodiment of this application.

Referring to FIG. 4, FIG. 4 is a schematic flowchart of a method for updating a used right-of-way level according to an embodiment of this application. Based on the embodiments shown in FIG. 2 and FIG. 3, the method may further include the following steps.

Step 401: The management center updates the function information of the first vehicle to updated function information.

In this embodiment of this application, the management center may obtain the updated function information in multiple manners.

In a possible implementation of this application, the management center may query a vehicle manufacturer, a vehicle management organization, or the like for the function information of the first vehicle at any time, and when found function information does not match function information that is currently used by the first vehicle, use the found function information as the updated function information.

In another possible implementation of this application, when a function of the first vehicle changes, the first vehicle sends a function information update application message to the management center, and the function information update application message may include the updated function information. The management center may examine the updated function information, to determine whether to update the function information of the first vehicle. Information exchange may be performed with the first vehicle or another functional entity to determine a reason why the function of the first vehicle changes. The function information of the first vehicle is updated, only when the first vehicle is allowed to apply for updating the function information, to the updated function information for which the first vehicle applies.

In the technical solution provided in this embodiment of this application, the management center may selectively update function information of a vehicle in a manner in which the vehicle makes a request and the management center gives examination, to improve safety in the ITS while meeting a vehicle requirement.

In another possible implementation of this application, the management center may receive a function update instruction message that is sent by a third-party entity and that includes the updated function information. The function update instruction message is used to instruct to update the function information of the first vehicle to the updated function information, and a user of the third-party entity has permission for updating the function information of the first vehicle.

In the technical solution provided in this embodiment of this application, the management center may update function information of a vehicle based on the instruction message sent by the third-party entity, to improve vehicle right-of-way management flexibility and extensibility.

Step 402: The management center updates the used right-of-way level of the first vehicle to an updated used right-of-way level according to the updated function information.

For example, the function information of the first vehicle is "a private car", and the used right-of-way level of the first vehicle is "0". When the first vehicle carries a patient that requires emergency treatment, the management center updates the function information "a private car" of the first vehicle to updated function information "an ambulance", and further the management center updates the used right-of-way level "0" of the first vehicle to an updated used right-of-way level "2" according to the updated function information "an ambulance". The right-of-way level "2" matches the function information "an ambulance".

In the technical solution provided in this embodiment of this application, the management center may correspondingly adjust a right-of-way level of a vehicle according to updated function information of the vehicle, to meet a requirement of the vehicle for a dynamically changing function.

In step 202 in the embodiment shown in FIG. 2, the management center schedules the road resource according to the used right-of-way level of the first vehicle. In this embodiment of this application, there are multiple road resource scheduling manners, and description is provided below by using an example and with reference to the accompanying drawings.

Figure 5:
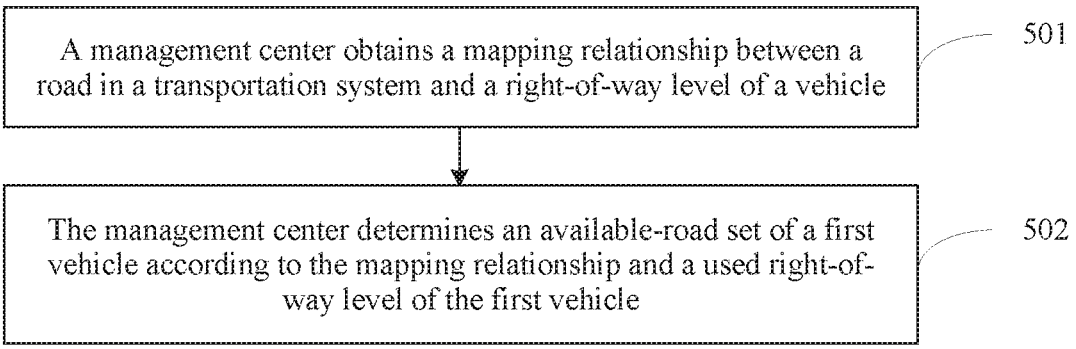
FIG. 5 is a schematic flowchart of a road resource scheduling method according to an embodiment of this application.

Referring to FIG. 5, FIG. 5 is a schematic flowchart of a road resource scheduling method according to an embodiment of this application. The road resource scheduling method may include the following steps.

Step 501: The management center obtains a mapping relationship between a road in a transportation system and a right-of-way level of a vehicle.

Generally, a vehicle of a special vehicle level has a higher passing efficiency requirement than a vehicle of a public vehicle level and a vehicle of a dedicated vehicle level. For example, an ambulance that carries a patient needs to send the patient to a hospital for treatment as soon as possible, and a fire engine that is executing a task needs to arrive at a fire scene as soon as possible to put out a fire.

To achieve the foregoing objective, in this embodiment of this application, a mapping relationship is set between a road and a right-of-way level, so that road resources that can be used by vehicles with different functions can be individually managed according to the mapping relationship.

Figure 6:
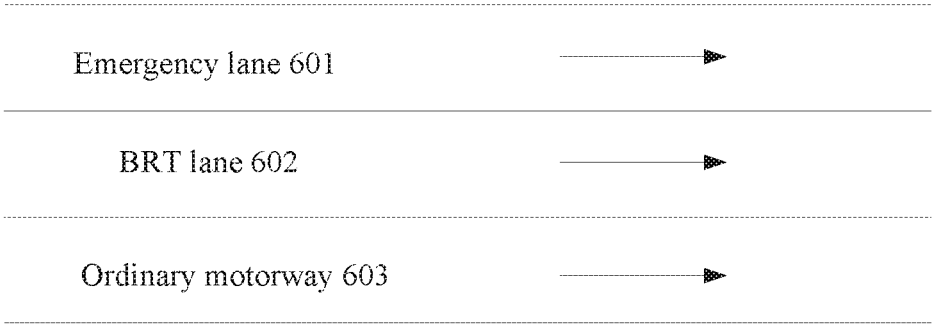
FIG. 6 is a schematic scenario diagram of another ITS according to an embodiment of this application.

Referring to FIG. 6, FIG. 6 is a schematic scenario diagram of another ITS according to an embodiment of this application. A road shown in FIG. 6 includes three lanes: an emergency lane 601, a BRT (Bus Rapid Transit, bus rapid transit) lane 602, and an ordinary motorway 603. In a possible embodiment of this application, the mapping relationship between a road and a right-of-way level is shown in Table 2.

TABLE 2

| | Right-of-way level | | |
|---|---|---|---|
| | 2 | 1 | 0 |
| Road | 601/602/603 | 602/603 | 603 |

That is, a vehicle of a used right-of-way level "2" can travel in any one of the emergency lane 601, the BRT lane 602, or the ordinary motorway 603, a vehicle of a used right-of-way level "1" can travel in the BRT lane 602 and the ordinary motorway 603, and a vehicle of a used right-of-way level "0" can travel only in the ordinary motorway 603.

In addition, the mapping relationship between a road and a right-of-way level may be set by the management center, or may be set by a third-party entity. The management center or a vehicle directly obtains the mapping relationship when the management center or the vehicle needs to use the mapping relationship, for example, the management center sends a mapping relationship query message to the third-party entity, or the vehicle sends a mapping relationship query message to the management center. The mapping relationship may be static, or may dynamically change according to real-time information in a transportation system. This shall fall within the protection scope of this application.

Step 502: The management center determines an available-road set of the first vehicle according to the mapping relationship and the used right-of-way level of the first vehicle, so that the management center can schedule a road in the available-road set for the first vehicle.

For example, according to the mapping relationship shown in Table 2, when the used right-of-way level of the first vehicle is "2", the available-road set of the first vehicle includes the emergency lane 601, the BRT lane 602, and the ordinary motorway 603. When the used right-of-way level of the first vehicle is "1", the available-road set of the first vehicle includes the BRT lane 602 and the ordinary motorway 603. When the used right-of-way level of the first vehicle is "0", the available-road set of the first vehicle includes the ordinary motorway 603.

In the technical solution provided in this embodiment of this application, road resources that can be used by vehicles with different functions can be individually managed by using the mapping relationship between a road and a right-of-way level, to meet special requirements of the vehicles with different functions. For example, when the first vehicle is a fire engine, and the used right-of-way level allocated to the first vehicle is "2", the first vehicle may use any one of the emergency lane 601, the BRT lane 602, or the ordinary motorway 603, to quickly arrive at a fire scene.

In the foregoing embodiment, the management center actively schedules a road resource for a vehicle according to a used right-of-way level of the vehicle. In addition, the management center may further schedule a road resource for the vehicle based on a road application message of the vehicle, to provide a personalized road resource scheduling service such as a path planning service for the vehicle according to related information in the road application message.

Figure 7:
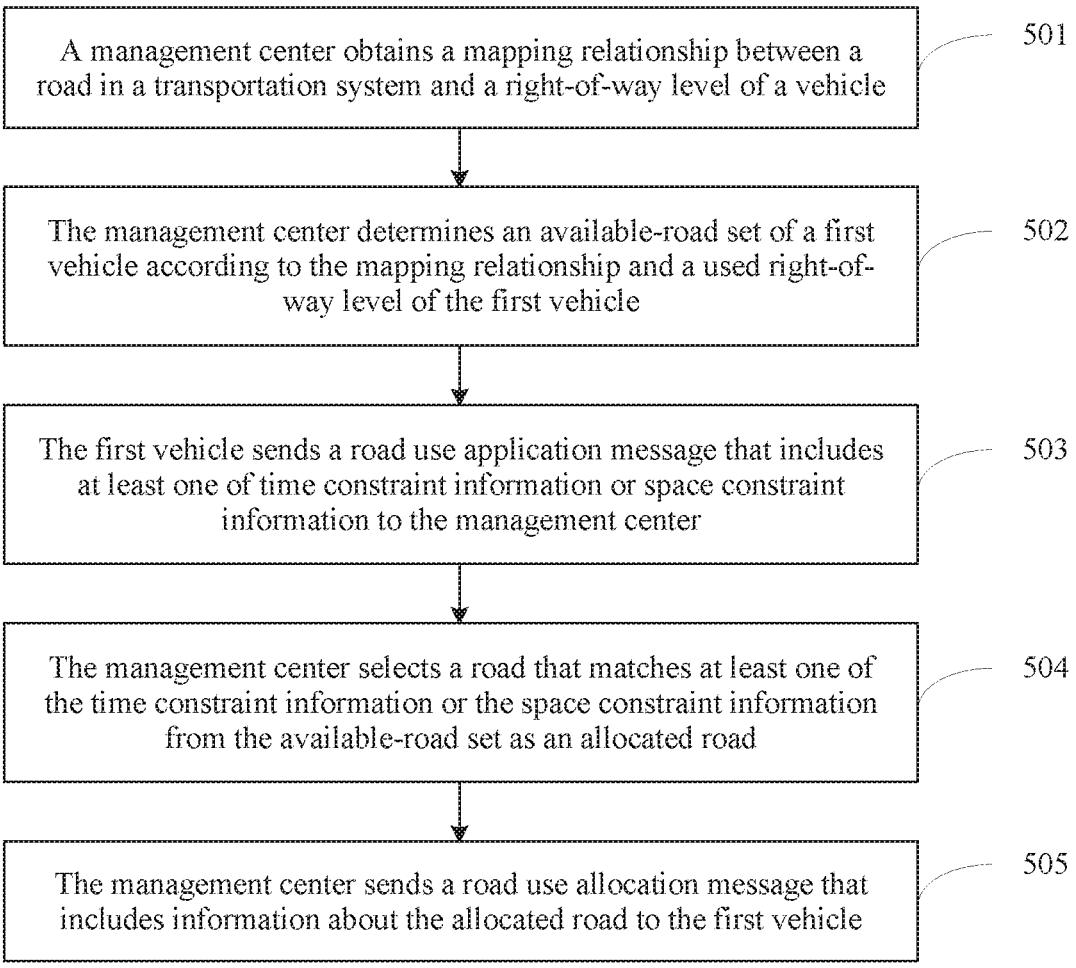
FIG. 7 is a schematic flowchart of another road resource scheduling method according to an embodiment of this application.

Referring to FIG. 7, FIG. 7 is a schematic flowchart of another road resource scheduling method according to an embodiment of this application. Based on the embodiment shown in FIG. 5, the road resource scheduling method may further include the following steps.

Step 503: The first vehicle sends a road use application message that includes at least one of time constraint information or space constraint information to the management center.

The time constraint information may include a time sequence of a start point of the first vehicle, a destination of the first vehicle, and a place through which the first vehicle is to pass. The space constraint information may include a space coordinate sequence of the start point of the first vehicle, the destination of the first vehicle, and the place through which the first vehicle is to pass. To help a person skilled in the art better understand a role played by the time constraint information and the space constraint information in road resource scheduling, description is provided below by using examples and with reference to FIG. 8A and FIG. 8B.

Figure 8A:
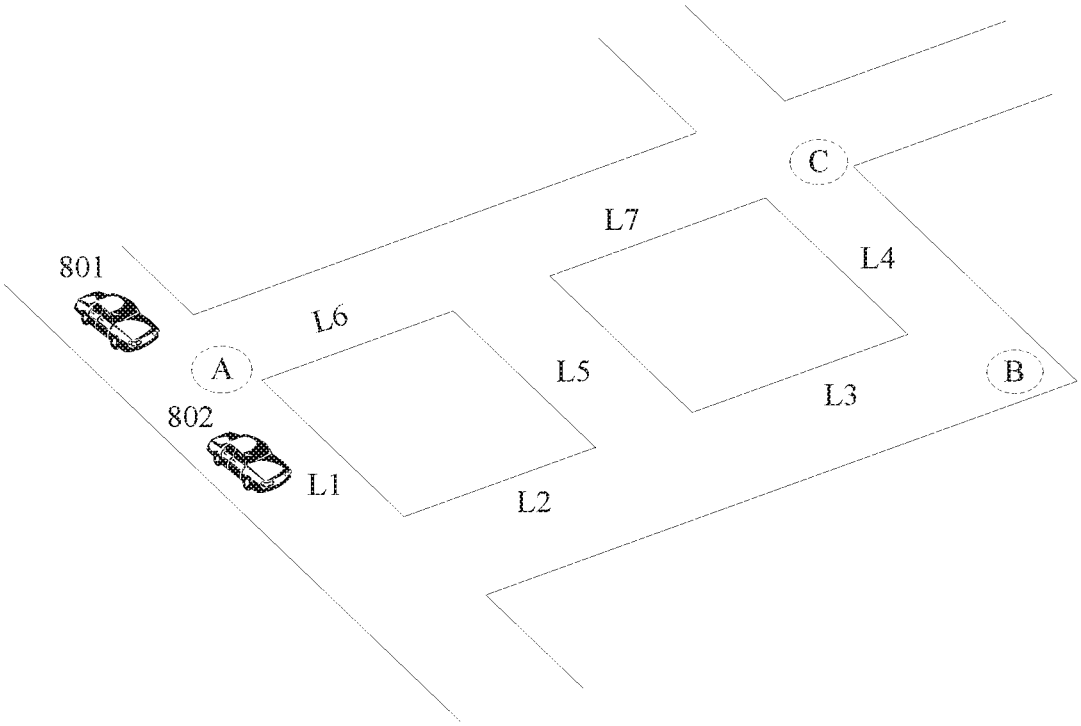
FIG. 8A is a schematic scenario diagram of another ITS according to an embodiment of this application.

Referring to FIG. 8A, FIG. 8A is a schematic scenario diagram of another ITS according to an embodiment of this application. FIG. 8A shows a first vehicle 801, a second vehicle 802, and seven roads L1 to L7, and a mapping relationship between a road and a right-of-way level is shown in Table 3.

TABLE 3

| | Right-of-way level | | |
|---|---|---|---|
| | 2 | 1 | 0 |
| Road resource | L1-L7 | L1-L6 | L1-L4 |

If a used right-of-way level of the first vehicle 801 is "1", and a used right-of-way level of the second vehicle 802 is "2", an available-road set of the first vehicle 801 includes roads L1 to L6, and an available-road set of the second vehicle 802 includes roads L1 to L7.

Step 504: The management center selects a road that matches at least one of the time constraint information or the space constraint information from the available-road set as an allocated road.

For example, a space coordinate sequence of the first vehicle 801 includes coordinates of A, B, and C. A and C are respectively a start point and a destination of the first vehicle, and B is a place through which the first vehicle is to pass. A time coordinate sequence of the first vehicle 801 includes 8:00, 8:40, and 9:00. That is, the first vehicle 801 is to depart from A at 8:00, pass through B at 8:40, and arrive at C at 9:00. Therefore, the management center may plan a path A→B→C for the first vehicle 801 according to a road resource in a time period from 8:00 to 9:00.

It is assumed that the second vehicle 802 is to use the road L1 in a time period from 7:00 to 7:30. Although the road L1 is also in the available-road set of the first vehicle 801, because the first vehicle 801 and the second vehicle 802 use the road L1 at different times, the road L1 may still be used to plan a traveling path for the first vehicle 801. Therefore, a path planned by the management center for the first vehicle 801 according to time constraint information and space constraint information of the first vehicle 801 is L1→L2→L3→L4 or L6→L5→L3→L4, so that the first vehicle 801 can arrive at C from A via B along either of the foregoing paths.

It is assumed that the second vehicle 802 is to use the road L1 in a time period from 8:00 to 8:20, and a used right-of-way level of the second vehicle 802 is higher than a used right-of-way level of the first vehicle 801. Therefore, the road L1 cannot be used to plan a traveling path for the first vehicle 801, and a path planned by the management center for the first vehicle 801 according to time constraint information and space constraint information of the first vehicle 801 is L6→L5→L3→L4, so that the first vehicle 801 can arrive at C from A via B only along the foregoing path.

Step 505: The management center sends a road use allocation message that includes information about the allocated road to the first vehicle.

Figure 8B:
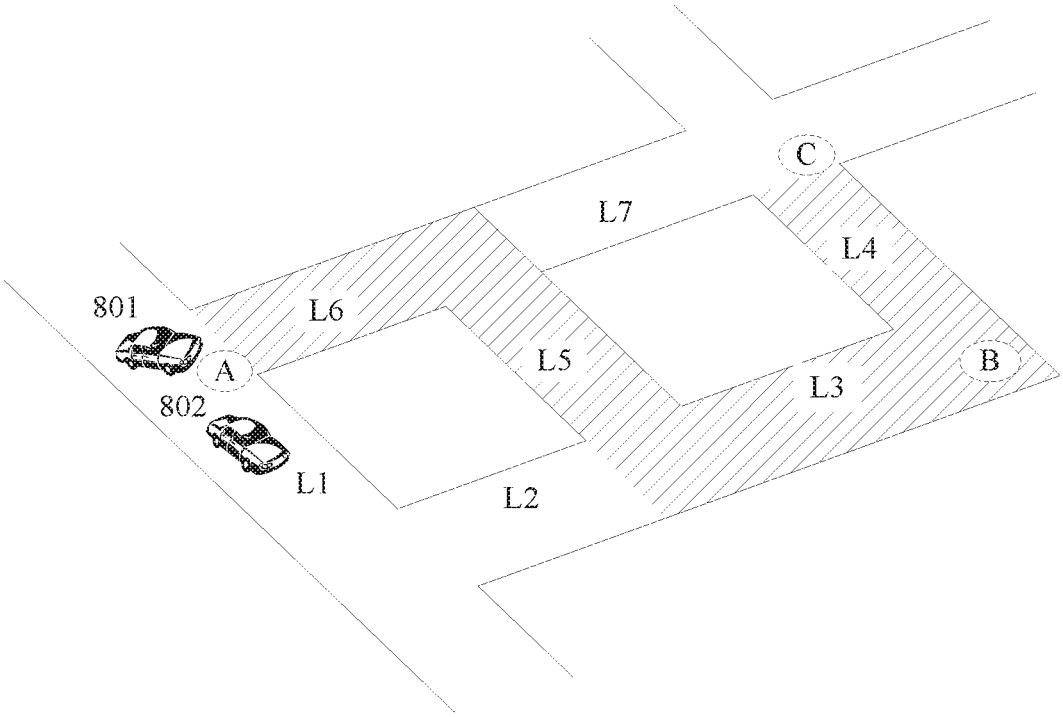
FIG. 8B is a schematic scenario diagram of another ITS according to an embodiment of this application.

For example, in the embodiment shown in FIG. 8A, the management center sends road allocation information L6→L5→L3→L4 to the first vehicle 801, and the first vehicle 801 may travel along the foregoing path, as shown in FIG. 8B.

In the method provided in this embodiment of this application, the management center may allocate a road resource for a vehicle according to a right-of-way level of the vehicle and a road constraint condition, to meet a road resource scheduling requirement of a user.

In step 303 in the embodiment shown in FIG. 3, the road resource is used according to the used right-of-way level of the first vehicle. In this embodiment of this application, there are multiple implementations of using a road resource according to a used right-of-way level by a vehicle, and description is provided below by using an example and with reference to the accompanying drawings.

Figure 9:
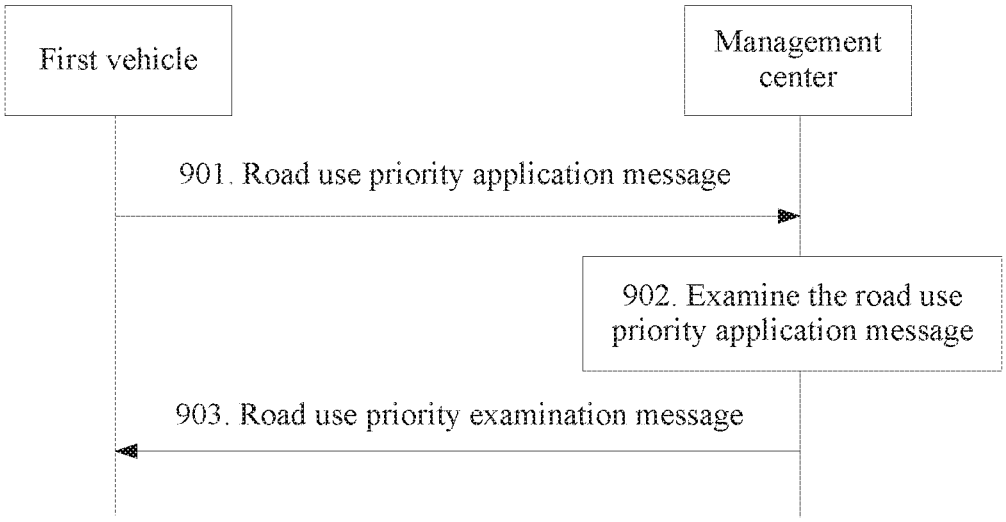
FIG. 9 is a schematic flowchart of a method for using a road resource according to a used right-of-way level by a vehicle according to an embodiment of this application.

Referring to FIG. 9, FIG. 9 is a schematic flowchart of a method for using a road resource according to a used right-of-way level by a vehicle according to an embodiment of this application. The method for using a road resource according to a used right-of-way level may include the following steps.

Step 901: A first vehicle sends a road use priority application message to a management center.

In an ITS, multiple vehicles usually travel simultaneously, and different vehicles contend for a road resource. If there is a conflict between the first vehicle and a second vehicle over use of a road, the management center needs to coordinate the first vehicle and the second vehicle. That there is a conflict between the first vehicle and a second vehicle over use of a road means that the first vehicle and the second vehicle use a minimum resource unit at a same time or are to use a minimum resource unit at a same time. The minimum resource unit may be correspondingly adjusted according to a refinement degree of controlling a road resource by the management center. For example, in terms of a length of a road, the road may be divided into equal lengths by using 30, 50, or 100 meters as a unit, and in terms of a width of the road, the road may be divided into equal widths by using a width of one lane or widths of two or more lanes as a unit, to form the minimum resource unit.

Figure 10:
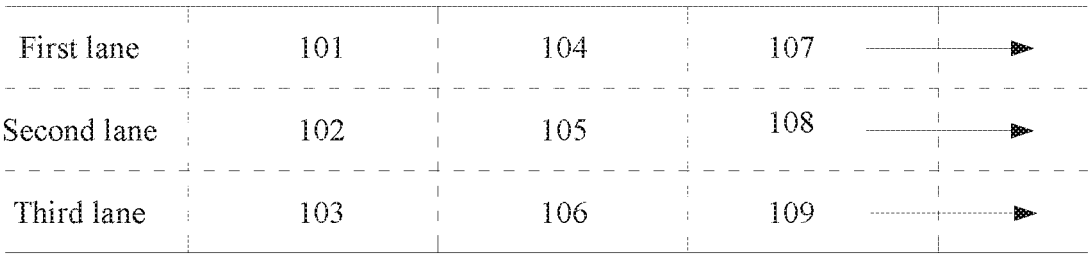
FIG. 10 is a schematic division diagram of a minimum resource unit according to an embodiment of this application.

Referring to FIG. 10, FIG. 10 is a schematic division diagram of a minimum resource unit according to an embodiment of this application. In a road shown in FIG. 10, there are three lanes with a same direction. In terms of a length of the road, the road is divided into equal lengths by using 50 meters as a unit, and in terms of a width of the road, the road is divided into equal widths by using a width of one lane as a unit. Minimum resource units obtained by dividing the road are 101 to 109. The minimum resource unit 101 is used as an example. For example, if the first vehicle and the second vehicle use the minimum resource unit 101 at a same time or are to use the minimum resource unit 101 at a same time, there is a conflict between the first vehicle and the second vehicle.

In this embodiment of this application, when a road to be used by the first vehicle is being used by the second vehicle, and there is a conflict between the first vehicle and the second vehicle over use of the road (there is a minimum resource unit to be used on the road at a same time), the road use priority application message is sent to the management center.

For example, when the first vehicle travels along a first lane shown in FIG. 10, and is about to travel into the minimum resource unit 104, it is detected that the second vehicle is traveling in the minimum resource unit 104. Therefore, there is a conflict between the first vehicle and the second vehicle over use of the road, and the first vehicle may send the road use priority application message to the management center, and request the management center to examine preferential use permission on the road.

Step 902: The management center examines the road use priority application message.

After receiving the road use priority application message sent by the first vehicle, the management center may examine the road use priority application message according to a used right-of-way level of the first vehicle and a used right-of-way level of the second vehicle. If the used right-of-way level of the first vehicle is higher than the used right-of-way level of the second vehicle, the road use priority examination message indicates that the first vehicle has a higher priority of using the road than the second vehicle. Otherwise, the road use priority examination message indicates that the first vehicle is rejected to have a higher priority of using the road than the second vehicle. That is, when there is a conflict between different vehicles over use of a same road, the road is preferentially allocated to a vehicle of a higher used right-of-way level for use.

The management center may obtain the used right-of-way level of the first vehicle and the used right-of-way level of the second vehicle in multiple manners, and this is not limited in this embodiment of this application. For example, the management center stores used right-of-way levels of all vehicles, and the management center may directly read the used right-of-way level of the first vehicle and the used right-of-way level of the second vehicle; or the management center separately receives right-of-way notification messages sent by the first vehicle and the second vehicle, and the management center is notified of the used right-of-way level of the first vehicle and the used right-of-way level of the second vehicle; or the management center sends a right-of-way query message to each of the first vehicle and the second vehicle, and after receiving the right-of-way query message, the first vehicle and the second vehicle send right-of-way notification messages to the management center, and notify the management center of the used right-of-way level of the first vehicle and the used right-of-way level of the second vehicle.

Step 903: The management center sends a road use priority examination message to the first vehicle.

When the used right-of-way level of the first vehicle is higher than the used right-of-way level of the second vehicle, the road use priority examination message indicates that the first vehicle has a higher priority of using the road than the second vehicle. The management center may further send a road use priority notification message to the second vehicle, and when the road use priority notification message indicates that the management center allows the first vehicle to have a higher priority of using the road than the second vehicle, the second vehicle may take avoidance measures and the like, so that use of the road by the second vehicle is preferentially met.

FIG. 10 is still used as an example. When there is a conflict between the first vehicle and the second vehicle over use of the minimum resource unit 104, and the used right-of-way level of the first vehicle is higher than the used right-of-way level of the second vehicle, the management center sends a road use priority examination message to the first vehicle, to indicate that the first vehicle is allowed to have a higher priority of using the road than the second vehicle. In addition, the management center sends a road use priority notification message to the second vehicle, to remind the first vehicle to give way to the first vehicle by using a second lane or a third lane, and leave the first lane for the first vehicle, that is, the management center instructs the second vehicle to give way to the first vehicle.

In addition, when there is a conflict between the first vehicle and the second vehicle over use of the minimum resource unit 104, and the used right-of-way level of the first vehicle is higher than the used right-of-way level of the second vehicle, the second vehicle may actively obtain the used right-of-way level of the first vehicle. When the used right-of-way level of the first vehicle is higher than the used right-of-way level of the second vehicle, use of the road by the first vehicle is preferentially met, for example, the second vehicle gives way to the first vehicle, that is, the second vehicle actively determines whether there is a need to give way to the first vehicle.

On the contrary, when there is a conflict between the first vehicle and the second vehicle over use of the minimum resource unit 104, and the used right-of-way level of the first vehicle is lower than or equal to the used right-of-way level of the second vehicle, the management center sends a road use priority examination message to the first vehicle, to indicate that the first vehicle is rejected to have a higher priority of using the road than the second vehicle. In this case, the first vehicle may not use the first lane until the second vehicle finishes using the first lane, or the management center allocates a second lane or a third lane to the first vehicle for traveling.

In the technical solution provided in this embodiment of this application, when there is a conflict between different vehicles over use of a same road, the management center properly allocates road resources to the vehicles, so that not only safety of the vehicles can be ensured, but also passing efficiency of the vehicles can be improved.

In the foregoing technical solution, when there is a conflict between different vehicles over use of a same road, one of the vehicles sends an application, and the management center examines the application. In another possible implementation of this application, one of the vehicles sends an application, and another vehicle examines the application.

Figure 11:
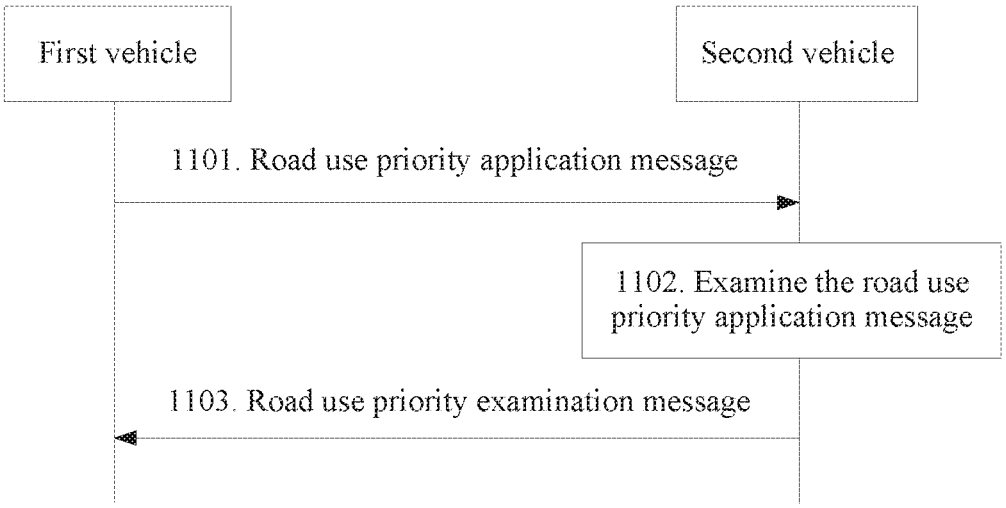
FIG. 11 is a schematic flowchart of another method for using a road resource according to a used right-of-way level by a vehicle according to an embodiment of this application.

Referring to FIG. 11, FIG. 11 is a schematic flowchart of another method for using a road resource according to a used right-of-way level by a vehicle according to an embodiment of this application. The method for using a road resource according to a used right-of-way level may include the following steps.

Step 1101: A first vehicle sends a road use priority application message to a second vehicle.

When a road to be used by the first vehicle is being used by the second vehicle, and there is a conflict between the first vehicle and the second vehicle over use of the road, the first vehicle sends the road use priority application message to the second vehicle. The road use priority application message includes a used right-of-way level of the first vehicle, so that the second vehicle obtains the used right-of-way level of the first vehicle.

Step 1102: The second vehicle examines the road use priority application message.

The second vehicle compares a used right-of-way level of the second vehicle with the used right-of-way level of the first vehicle, and further generates a road use priority examination message. If the used right-of-way level of the first vehicle is higher than the used right-of-way level of the second vehicle, the road use priority examination message indicates that the first vehicle has a higher priority of using the road than the second vehicle, and the second vehicle may actively give way to the first vehicle. Otherwise, the road use priority examination message indicates that the first vehicle is rejected to have a higher priority of using the road than the second vehicle.

Step 1103: The second vehicle sends a road use priority examination message to the first vehicle.

The technical solution provided in this embodiment of this application is basically similar to the technical solution in the embodiment shown in FIG. 9. A difference between the two technical solutions lies in that the road use priority application message in this embodiment of this application is examined by the second vehicle, but the road use priority application message in the embodiment shown in FIG. 9 is examined by the management center. For descriptions of another part, refer to each other. For brevity, details are not described herein.

Figure 12:
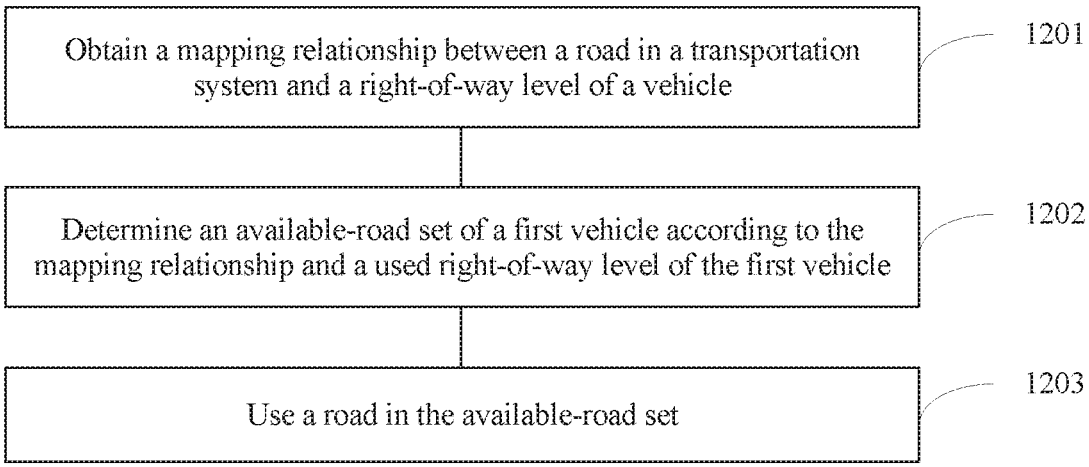
FIG. 12 is a schematic flowchart of another method for using a road resource according to a used right-of-way level by a vehicle according to an embodiment of this application.

Referring to FIG. 12, FIG. 12 is a schematic flowchart of another method for using a road resource according to a used right-of-way level by a vehicle according to an embodiment of this application. The method for using a road resource according to a used right-of-way level may include the following steps.

Step 1201: A first vehicle obtains a mapping relationship between a road in a transportation system and a right-of-way level of a vehicle, where the mapping relationship is static or dynamically changes.

The first vehicle may obtain the mapping relationship between a road and a right-of-way level of a vehicle from a management center or another functional entity.

Step 1202: The first vehicle determines an available-road set of the first vehicle according to the mapping relationship and a used right-of-way level of the first vehicle.

Step 1203: The first vehicle uses a road in the available-road set.

In the technical solution provided in this embodiment of this application, the management center may actively select a road, to prevent a vehicle from using, in an unauthorized manner, of a road that does not match a used right-of-way level of the vehicle.

In addition, when the used right-of-way level of the first vehicle does not match a road that is being used or to be used by the first vehicle, a right-of-way alarm message sent by another traffic participating entity may be further received. The right-of-way alarm message is used to indicate that the used right-of-way level of the first vehicle does not match a road for which the first vehicle requests to use or the road that is being used by the first vehicle, to remind the first vehicle.

The another traffic participating entity in the transportation system includes a second vehicle, the management center, or a roadside infrastructure in the transportation system. The roadside infrastructure is an intelligent device that has a message receiving and sending function.

Corresponding to the vehicle right-of-way management method provided in the embodiments of this application, the embodiments of this application further provide a vehicle right-of-way management apparatus.

Figure 13:
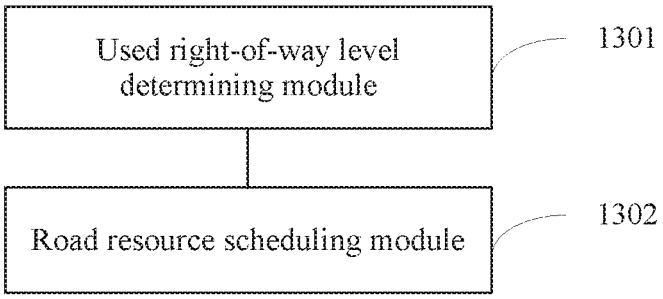
FIG. 13 is a schematic structural diagram of a vehicle right-of-way management apparatus according to an embodiment of this application.

Referring to FIG. 13, FIG. 13 is a schematic structural diagram of a vehicle right-of-way management apparatus according to an embodiment of this application. The vehicle right-of-way management apparatus is applied to a management center, and may include a used right-of-way level determining module 1301 and a road resource scheduling module 1302.

The used right-of-way level determining module 1301 is configured to determine a used right-of-way level of a first vehicle according to function information of the first vehicle. The used right-of-way level of the first vehicle includes a right-of-way level that the management device allows the first vehicle to use.

The road resource scheduling module 1302 is configured to schedule a road resource for the first vehicle according to the used right-of-way level of the first vehicle.

In a possible implementation of this application, the apparatus further includes a right-of-way instruction message sending module, configured to send a right-of-way instruction message to the first vehicle. The right-of-way instruction message includes the used right-of-way level of the first vehicle, and is used to instruct the first vehicle to use the used right-of-way level of the first vehicle.

In a possible implementation of this application, the apparatus further includes a right-of-way application message receiving module, configured to receive a right-of-way application message sent by the first vehicle. The right-of-way application message is used to apply for the used right-of-way level of the first vehicle.

In a possible implementation of this application, the right-of-way application message includes a right-of-way level for which the first vehicle applies, and is used to request to use the right-of-way level for which the first vehicle applies as the used right-of-way level of the first vehicle, and the used right-of-way level determining module further includes:

a matched right-of-way level determining submodule, configured to determine, according to the function information, a right-of-way level that matches the function information; and a used right-of-way level determining submodule, configured to: when there is an intersection set between the matched right-of-way level and the right-of-way level for which the first vehicle applies, use a right-of-way level in the intersection set as the used right-of-way level of the first vehicle; or otherwise, use the matched right-of-way level as the used right-of-way level of the first vehicle.

In a possible implementation of this application, the apparatus further includes: a function information update module, configured to update the function information of the first vehicle to updated function information; and a used right-of-way level update module, configured to update the used right-of-way level of the first vehicle to an updated used right-of-way level according to the updated function information.

In a possible implementation of this application, the apparatus further includes: a function update application message receiving module, configured to receive a function update application message sent by the first vehicle, where the function update application message includes the updated function information for which the first vehicle applies; and a function information update determining module, configured to update, only when it is determined that the first vehicle is allowed to apply for updating the function information, the function information of the first vehicle to the updated function information for which the first vehicle applies.

In a possible implementation of this application, the apparatus further includes a function update instruction message receiving module, configured to receive a function update instruction message that is sent by a third-party entity and that includes the updated function information. The function update instruction message is used to instruct to update the function information of the first vehicle to the updated function information, and a user of the third-party entity has permission for updating the function information of the first vehicle.

In a possible implementation of this application, the road resource scheduling module includes: a mapping relationship obtaining module, configured to obtain a mapping relationship between a road in a transportation system and a right-of-way level of a vehicle, where the mapping relationship is static or dynamically changes; and an available-road set determining module, configured to determine an available-road set of the first vehicle according to the mapping relationship and the used right-of-way level of the first vehicle.

In a possible implementation of this application, the apparatus further includes: a road use application message receiving module, configured to receive a road use application message that is sent by the first vehicle and that includes at least one of time constraint information or space constraint information; an allocated-road selection module, configured to select a road that matches at least one of the time constraint information or the space constraint information from the available-road set as an allocated road; and a road use allocation message sending module, configured to send a road use allocation message that includes information about the allocated road to the first vehicle.

In a possible implementation of this application, the road resource scheduling module includes: a to-be-allocated road determining submodule, configured to determine, according to the used right-of-way level of the first vehicle, a road to be allocated to the first vehicle for use; and a road scheduling submodule, configured to: when the road to be allocated to the first vehicle for use has been allocated to a second vehicle for use, and there is a conflict between the first vehicle and the second vehicle over use of the road, if the used right-of-way level of the first vehicle is higher than a used right-of-way level of the second vehicle, first schedule the road for the first vehicle for use; or otherwise, later schedule the road for the first vehicle for use, or schedule another road for the first vehicle for use.

In a possible implementation of this application, the road resource scheduling module includes: a road use priority application message receiving submodule, configured to receive a road use priority application message sent by the first vehicle, where the road use priority application message is used to apply for a higher priority of using a road than a second vehicle; and a road use priority examination message sending submodule, configured to send a road use priority examination message to the first vehicle, where if the used right-of-way level of the first vehicle is higher than a used right-of-way level of the second vehicle, the road use priority examination message indicates that the first vehicle has a higher priority of using the road than the second vehicle; or otherwise, the road use priority examination message indicates that the first vehicle is rejected to have a higher priority of using the road than the second vehicle.

In a possible implementation of this application, the apparatus further includes a first right-of-way notification message transceiver module, configured to: receive a right-of-way notification message sent by the first vehicle, or receive the right-of-way notification message after sending a right-of-way query message to the first vehicle. The right-of-way notification message includes the used right-of-way level of the first vehicle.

Figure 14:
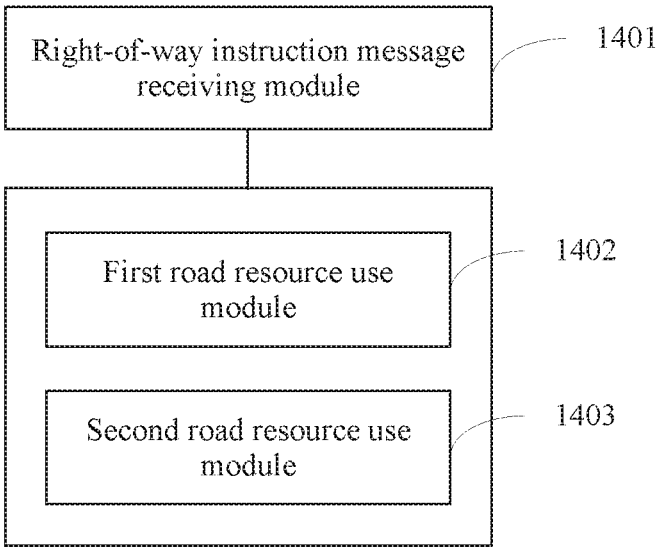
FIG. 14 is a schematic structural diagram of another vehicle right-of-way management apparatus according to an embodiment of this application.

Referring to FIG. 14, FIG. 14 is a schematic structural diagram of another vehicle right-of-way management apparatus according to an embodiment of this application. The vehicle right-of-way management apparatus is applied to a first vehicle, and may include a right-of-way instruction message receiving module 1401 and at least one of a first road resource use module 1402 or a second road resource use module 1403.

The right-of-way instruction message receiving module 1401 is configured to receive a right-of-way instruction message sent by a management device. The right-of-way instruction message includes a used right-of-way level of the first vehicle, and is used to instruct the first vehicle to use the used right-of-way level of the first vehicle, and the used right-of-way level of the first vehicle is determined by the management device according to function information of the first vehicle.

The first road resource use module 1402 is configured to use a road resource according to the used right-of-way level of the first vehicle.

The second road resource use module 1403 is configured to use a road resource that is scheduled by the management device according to the used right-of-way level of the first vehicle.

In a possible implementation of this application, the apparatus further includes a right-of-way application message sending module, configured to send a right-of-way application message to the management device. The right-of-way application message is used to apply for the used right-of-way level of the first vehicle.

In a possible implementation of this application, the right-of-way application message includes a right-of-way level for which the first vehicle applies, and is used to request to use the right-of-way level for which the first vehicle applies as the used right-of-way level of the first vehicle.

In a possible implementation of this application, the apparatus further includes a function update application message sending module, configured to send a function update application message to the management device. The function update application message is used to instruct the management device to update the function information of the first vehicle to updated function information, and the function update application message includes the updated function information.

In a possible implementation of this application, the second road resource use module includes: a road use application message sending submodule, configured to send a road use application message that includes at least one of time constraint information or space constraint information to the management device; and a road use allocation message receiving submodule, configured to receive a road use allocation message that is sent by the management device and that includes information about an allocated road. The allocated road matches the used right-of-way level of the first vehicle and at least one of the time constraint information or the space constraint information.

In a possible implementation of this application, the first road resource use module includes: a road use priority application message sending submodule, configured to: when a road to be used by the first vehicle is being used by a second vehicle, and there is a conflict between the first vehicle and the second vehicle over use of the road, send a road use priority application message to the management device or the second vehicle, where the road use priority application message sent to the second vehicle includes the used right-of-way level of the first vehicle; and a road use priority examination message receiving submodule, configured to receive a road use priority examination message sent by the management device or the second vehicle, where if the used right-of-way level of the first vehicle is higher than a used right-of-way level of the second vehicle, the road use priority examination message indicates that the first vehicle has a higher priority of using the road than the second vehicle; or otherwise, the road use priority examination message indicates that the first vehicle is rejected to have a higher priority of using the road than the second vehicle.

In a possible implementation of this application, the first road resource use module includes: a road use priority notification message receiving submodule, configured to receive a road use priority notification message sent by the management device, where the road use priority notification message indicates that the management device allows a second vehicle to have a higher priority of using a road than the first vehicle; and a first road use priority execution submodule, configured to preferentially meet use of the road by the second vehicle.

In a possible implementation of this application, the first road resource use module includes: a used right-of-way level obtaining submodule, configured to: when a road to be used by the first vehicle is being used by a second vehicle, and there is a conflict between the first vehicle and the second vehicle over use of the road, obtain a used right-of-way level of the second vehicle; and a second road use priority execution submodule, configured to: when the used right-of-way level of the second vehicle is higher than the used right-of-way level of the first vehicle, preferentially meet use of the road by the second vehicle.

In a possible implementation of this application, the apparatus further includes a second right-of-way notification message transceiver module, configured to: send a right-of-way notification message to another traffic participating entity in a transportation system, or send the right-of-way notification message to the another traffic participating entity in the transportation system after receiving a right-of-way query message sent by the another traffic participating entity. The right-of-way notification message includes the used right-of-way level of the first vehicle.

In a possible implementation of this application, the first road resource use module includes: a mapping relationship obtaining submodule, configured to obtain a mapping relationship between a road in a transportation system and a right-of-way level of a vehicle, where the mapping relationship is static or dynamically changes; an available-road set determining submodule, configured to determine an available-road set of the first vehicle according to the mapping relationship and the used right-of-way level of the first vehicle; and a road use execution submodule, configured to use a road in the available-road set.

In a possible implementation of this application, a mapping relationship is statically or dynamically set between a road in a transportation system and a right-of-way level of a vehicle, and the first road resource use module includes a right-of-way alarm message receiving submodule, configured to receive a right-of-way alarm message sent by the another traffic participating entity in the transportation system. The right-of-way alarm message is used to indicate that the used right-of-way level of the first vehicle does not match a road for which the first vehicle applies for use or a road that is being used by the first vehicle.

In a possible implementation of this application, the another traffic participating entity in the transportation system includes a second vehicle, the management device, or a roadside infrastructure in the transportation system.

For a relationship between function units in the vehicle right-of-way management apparatus provided in this embodiment of this application, refer to the steps in the foregoing vehicle right-of-way management method. Details are not described herein.

Corresponding to the vehicle right-of-way management method, this application further provides a management center and a vehicle.

Figure 15:
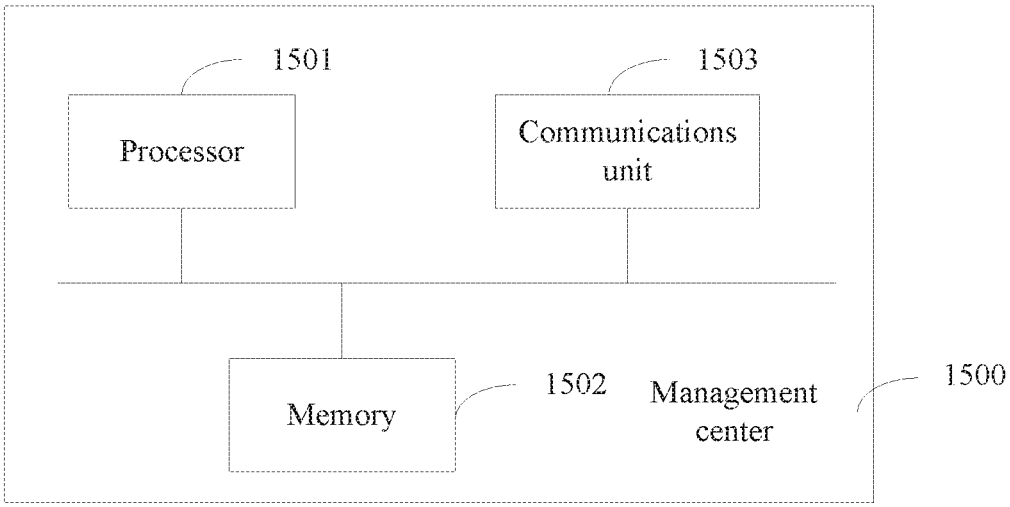
FIG. 15 is a schematic structural diagram of a management center according to an embodiment of this application.

Referring to FIG. 15, FIG. 15 is a schematic structural diagram of a management center according to an embodiment of this application. The management center 1500 may include a processor 1501, a memory 1502, and a communications unit 1503. These components communicate by using one or more buses. A person skilled in the art may understand that a structure of a server shown in the figure does not constitute a limitation on this application. The structure may be a bus structure, or may be a star structure, or may further include more or fewer components than those shown in the figure, or combine some components, or have different component arrangements.

The communications unit 1503 is configured to: establish a communications channel, so that the storage device can communicate with another device; and receive user data sent by the another device or send user data to the another device.

The processor 1501 is a control center of the storage device, connects to various parts of the entire electronic device by using various interfaces and lines, and performs various functions of the electronic device and/or data processing by running or executing a software program and/or a module stored in the memory 1502 and invoking data stored in the memory. The processor may include an integrated circuit (Integrated Circuit, IC for short), for example, may include a single packaged IC, or may include multiple packaged ICs with a same function or different functions. For example, the processor 1501 may include only a central processing unit (Central Processing Unit, CPU for short). In this implementation of this application, the CPU may be a single computing core, or may include multiple computing cores.

The memory 1502 is configured to store an execution instruction of the processor 1501. The memory 1502 may be implemented by any type of a volatile or nonvolatile storage device or a combination thereof, for example, a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic disk, or an optical disc.

When the execution instruction in the memory 1502 is executed by the processor 1501, the management center 1500 can perform steps on a management center side in the foregoing methods.

Figure 16:
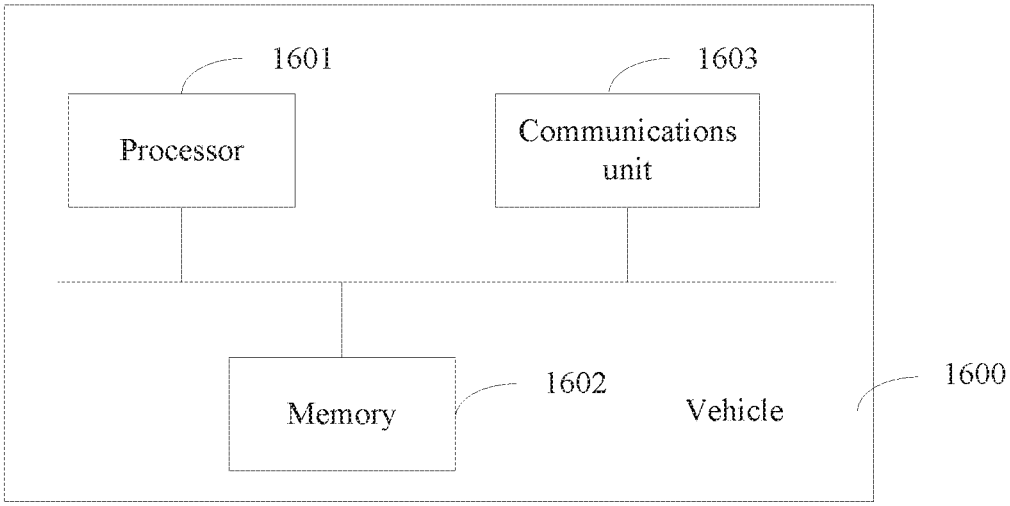
FIG. 16 is a schematic structural diagram of a vehicle according to an embodiment of this application.

Referring to FIG. 16, FIG. 16 is a schematic structural diagram of a vehicle according to an embodiment of this application. The vehicle 1600 may include a processor 1601, a memory 1602, and a communications unit 1603. These components communicate by using one or more buses. A person skilled in the art may understand that a structure of a server shown in the figure does not constitute a limitation on this application. The structure may be a bus structure, or may be a star structure, or may further include more or fewer components than those shown in the figure, or combine some components, or have different component arrangements.

The communications unit 1603 is configured to: establish a communications channel, so that the storage device can communicate with another device; and receive user data sent by the another device or send user data to the another device.

The processor 1601 is a control center of the storage device, connects to various parts of the entire electronic device by using various interfaces and lines, and performs various functions of the electronic device and/or data processing by running or executing a software program and/or a module stored in the memory 1602 and invoking data stored in the memory. The processor may include an integrated circuit (Integrated Circuit, IC for short), for example, may include a single packaged IC, or may include multiple packaged ICs with a same function or different functions. For example, the processor 1601 may include only a central processing unit (Central Processing Unit, CPU for short). In this implementation of this application, the CPU may be a single computing core, or may include multiple computing cores.

The memory 1602 is configured to store an execution instruction of the processor 1601. The memory 1602 may be implemented by any type of a volatile or nonvolatile storage device or a combination thereof, for example, a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic disk, or an optical disc.

When the execution instruction in the memory 1602 is executed by the processor 1601, the vehicle 1600 can perform steps on a vehicle side in the foregoing methods.

During specific implementation, an embodiment of this application further provides a computer storage medium, where the computer storage medium may store a program, and when the program is executed, a part or all of the steps of the embodiments of the calling method provided in this application may be performed. The foregoing storage medium may include a magnetic disk, an optical disc, a read-only memory (English: Read-Only Memory, ROM for short), or a random access memory (English: Random Access Memory, RAM for short).

A person skilled in the art may clearly understand that, the technologies in the embodiments of this application may be implemented by software in addition to a necessary general hardware platform. Based on such an understanding, the technical solutions in the embodiments of this application essentially or the part contributing to the prior art may be implemented in a form of a software product. The software product is stored in a storage medium, such as a ROM/RAM, a hard disk, or an optical disc, and includes several instructions for instructing a computer device (which may be a personal computer, a server, or a network device) to perform the methods described in the embodiments or some parts of the embodiments of this application.

For same or similar parts in the embodiments in this specification, refer to these embodiments. Especially, apparatus and terminal embodiments are basically similar to a method embodiment, and therefore are described briefly. For related parts, refer to descriptions in the method embodiment.

What is claimed is:

1. A vehicle right-of-way management method, applied to a device in an Intelligent Transportation System (ITS), and comprising:

receiving, by the device, a right-of-way application message sent by a first vehicle to the device, wherein the right-of-way application message is used to apply for a right-of-way level of the first vehicle, the device allocates different right-of-way levels to different vehicles with different functions, and the device includes a control center of the ITS and is disposed in a specific place in the ITS; and in response to receiving the right-of-way application message:

determining, by the device, a function of the first vehicle, wherein the function of the first vehicle comprises one or more of an emergency function of the first vehicle, a public function of the first vehicle, or a dedicated function of the first vehicle;

obtaining, by the device, a mapping relationship between a right-of-way level and a function of a vehicle, wherein the mapping relationship dynamically changes based on real-time information in the ITS, and wherein obtaining the mapping relationship comprises:

sending a mapping relationship query message to a third-party entity; and receiving the mapping relationship from the third-party entity;

determining, by the device, the right-of-way level of the first vehicle according to the function of the first vehicle and the mapping relationship, wherein the ITS includes the device, a plurality of road resources, and a plurality of vehicles driving on the plurality of road resources, wherein the right-of-way level of the first vehicle comprises a right-of-way level that the device allows the first vehicle to use in the ITS, and wherein the right-of-way level of the first vehicle corresponds to one or more road resources in the plurality of road resources;

scheduling, by the device, a road resource from the one or more road resources for the first vehicle according to the right-of-way level of the first vehicle by:

receiving time constraint information in the one or more road resources for the first vehicle, wherein the time constraint information comprises a time coordinate sequence of the first vehicle corresponding to the one or more road resources; and determining an available-road set of the first vehicle based on the time coordinate sequence of the first vehicle and the one or more road resources; and sending, by the device to the first vehicle, the road resource to be used by the first vehicle.

2. The method according to claim 1, wherein the emergency function of the first vehicle comprises a use of the first vehicle as an ambulance or a firefighter vehicle, wherein the public function of the first vehicle comprises a use of the first vehicle as a bus or a school bus, and wherein the dedicated function of the first vehicle comprises a use of the first vehicle as a private car or a taxi.

3. The method according to claim 2, further comprising:

sending a right-of-way instruction message to the first vehicle, wherein the right-of-way instruction message comprises the right-of-way level of the first vehicle, and the right-of-way instruction message is used to instruct the first vehicle to use the right-of-way level of the first vehicle.

4. The method according to claim 3, wherein the right-of-way application message comprises a right-of-way level for which the first vehicle applies, and is used to request to use the right-of-way level for which the first vehicle applies as the right-of-way level of the first vehicle; and wherein determining the right-of-way level of the first vehicle according to the function of the first vehicle comprises:

determining, according to the function, a right-of-way level that matches the function; and when there is an intersection set between the matched right-of-way level and the right-of-way level for which the first vehicle applies, using a right-of-way level in the intersection set as the right-of-way level of the first vehicle; or otherwise, using the matched right-of-way level as the right-of-way level of the first vehicle.

5. The method according to claim 1, further comprising:

updating the function of the first vehicle to an updated function; and updating the right-of-way level of the first vehicle to an updated right-of-way level according to the updated function.

6. The method according to claim 1, wherein the time coordinate sequence of the first vehicle comprises a first timepoint for a start point of the first vehicle, a second timepoint for a destination of the first vehicle, and a third timepoint for a location that the first vehicle is to pass through, wherein the method further comprises:

determining a first road from the one or more road resources based on the first timepoint and the right-of-way level of the first vehicle, a second road from the one or more road resources based on the second timepoint and the right-of-way level of the first vehicle, and a third road from the one or more road resources based on the third timepoint and the right-of-way level of the first vehicle; and determining the available-road set that comprises a path that starts from the first road, passes through the third road, and ends with the second road.

7. The method according to claim 1, wherein the mapping relationship comprises a plurality of right-of-way levels and a plurality of vehicles functions, and each right-of-way level of the plurality of right-of-way levels corresponds to one or more vehicles functions of the plurality of vehicles functions.

8. A vehicle right-of-way management method, applied to a first vehicle in an Intelligent Transportation System (ITS), and comprising:

sending a right-of-way application message to a device, wherein the right-of-way application message is used to apply for a right-of-way level of the first vehicle, the device allocates different right-of-way levels to different vehicles with different functions, and the device includes a control center of the ITS and is disposed in a specific place; and in response to sending the right-of-way application message:

receiving a right-of-way instruction message sent by the device, wherein the ITS includes the device, a plurality of road resources, and a plurality of vehicles driving on the plurality of road resources, wherein the right-of-way instruction message comprises the right-of-way level of the first vehicle, and is used to instruct the first vehicle to use the right-of-way level of the first vehicle, wherein the right-of-way level of the first vehicle is determined by the device according to a function of the first vehicle and a mapping relationship between a right-of-way level and a function of a vehicle, and wherein the right-of-way level of the first vehicle corresponds to one or more road resources in the plurality of road resources, and wherein the function of the first vehicle comprises one or more of an emergency function of the first vehicle, a public function of the first vehicle, or a dedicated function of the first vehicle; and using a road resource from the one or more road resources that is scheduled by the device according to the right-of-way level of the first vehicle, wherein the road resource from the one or more road resources is scheduled by:

sending, to the device, time constraint information in the one or more road resources for the first vehicle, wherein the time constraint information comprises a time coordinate sequence of the first vehicle corresponding to the one or more road resources; and receiving, from the device, an available-road set of the first vehicle determined based on the time coordinate sequence of the first vehicle and the one or more road resources; and wherein using the road resource according to the right-of-way level of the first vehicle comprises:

obtaining the mapping relationship, wherein the mapping relationship is static or dynamically changes, and wherein obtaining the mapping relationship comprises:

sending a mapping relationship query message to a third-party entity; and receiving the mapping relationship from the third-party entity;

determining the available-road set of the first vehicle according to the mapping relationship and the right-of-way level of the first vehicle; and using a road in the available-road set.

9. The method according to claim 8, wherein the emergency function of the first vehicle comprises a use of the first vehicle as an ambulance or a firefighter vehicle, wherein the public function of the first vehicle comprises a use of the first vehicle as a bus or a school bus, and wherein the dedicated function of the first vehicle comprises a use of the first vehicle as a private car or a taxi.

10. The method according to claim 9, wherein the right-of-way application message comprises a right-of-way level for which the first vehicle applies, and is used to request to use the right-of-way level for which the first vehicle applies as the right-of-way level of the first vehicle.

11. The method according to claim 8, further comprising:

sending a function update application message to the device, wherein the function update application message is used to instruct the device to update the function of the first vehicle to an updated function, and wherein the function update application message comprises the updated function.

12. The method according to claim 8, wherein using the road resource that is scheduled by the device according to the right-of-way level of the first vehicle comprises:

sending a road use application message that comprises space constraint information to the device; and receiving a road use allocation message that is sent by the device and that comprises information about an allocated road, wherein the allocated road matches the right-of-way level of the first vehicle and the space constraint information.

13. The method according to claim 8, wherein using the road resource according to the right-of-way level of the first vehicle comprises:

when a road to be used by the first vehicle is being used by a second vehicle, and there is a conflict between the first vehicle and the second vehicle over use of the road, sending a road use priority application message to the device or the second vehicle, wherein the road use priority application message sent to the second vehicle comprises the right-of-way level of the first vehicle; and receiving a road use priority examination message sent by the device or the second vehicle, wherein if the right-of-way level of the first vehicle is higher than a right-of-way level of the second vehicle, the road use priority examination message indicates that the first vehicle has a higher priority of using the road than the second vehicle; or otherwise, the road use priority examination message indicates that the first vehicle is rejected to have the higher priority of using the road than the second vehicle.

14. The method according to claim 8, wherein using the road resource according to the right-of-way level of the first vehicle comprises:

receiving a road use priority notification message sent by the device, wherein the road use priority notification message indicates that the device allows a second vehicle to have a higher priority of using a road than the first vehicle; and preferentially meeting use of the road by the second vehicle.

15. The method according to claim 8, wherein using the road resource according to the right-of-way level of the first vehicle comprises:

when a road to be used by the first vehicle is being used by a second vehicle, and there is a conflict between the first vehicle and the second vehicle over use of the road, obtaining, by the first vehicle, a right-of-way level of the second vehicle; and when the right-of-way level of the second vehicle is higher than the right-of-way level of the first vehicle, preferentially meeting use of the road by the second vehicle.

16. The method according to claim 8, further comprising:

sending a right-of-way notification message to another traffic participating entity in the ITS, or sending the right-of-way notification message to the another traffic participating entity in the ITS after receiving a right-of-way query message sent by the another traffic participating entity, wherein the right-of-way notification message comprises the right-of-way level of the first vehicle.

17. The method according to claim 16, wherein the another traffic participating entity in the ITS comprises:

a second vehicle, the device, or a roadside infrastructure in the ITS.

18. The method according to claim 8, wherein using the road resource according to the right-of-way level of the first vehicle comprises:

receiving a right-of-way alarm message sent by another traffic participating entity in the ITS, wherein the right-of-way alarm message is used to indicate that the right-of-way level of the first vehicle does not match a road for which the first vehicle applies for use or a road that is being used by the first vehicle.

19. A device in an Intelligent Transportation System (ITS), comprising:

at least one processor; and a memory storing instructions for execution by the at least one processor to perform operations comprising:

receiving, by the device, a right-of-way application message sent by a first vehicle to the device, wherein the right-of-way application message is used to apply for a right-of-way level of the first vehicle, the device allocates different right-of-way levels to different vehicles with different functions, and the device includes a control center of the ITS and is disposed in a specific place in the ITS; and in response to receiving the right-of-way application message:

determining, by the device, a function of the first vehicle, wherein the function of the first vehicle comprises one or more of an emergency function of the first vehicle, a public function of the first vehicle, or a dedicated function of the first vehicle;

obtaining, by the device, a mapping relationship between a right-of-way level and a function of a vehicle, wherein the mapping relationship dynamically changes based on real-time information in the ITS, and wherein obtaining the mapping relationship comprises:

sending a mapping relationship query message to a third-party entity; and receiving the mapping relationship from the third-party entity;

determining, by the device, the right-of-way level of the first vehicle according to the function of the first vehicle and the mapping relationship, wherein the ITS includes the device, a plurality of road resources, and a plurality of vehicles driving on the plurality of road resources, wherein the right-of-way level of the first vehicle comprises a right-of-way level that the device allows the first vehicle to use in the ITS, and wherein the right-of-way level of the first vehicle corresponds to one or more road resources in the plurality of road resources;

scheduling, by the device, a road resource from the one or more road resources for the first vehicle according to the right-of-way level of the first vehicle by:

receiving time constraint information in the one or more road resources for the first vehicle, wherein the time constraint information comprises a time coordinate sequence of the first vehicle corresponding to the one or more road resources; and determining an available-road set of the first vehicle based on the time coordinate sequence of the first vehicle and the one or more road resources; and sending, by the device to the first vehicle, the road resource to be used by the first vehicle.

20. A vehicle, comprising:

at least one processor; and a memory storing instructions for execution by the at least one processor to perform operations comprising:

sending a right-of-way application message to a device, wherein the right-of-way application message is used to apply for a right-of-way level of the vehicle, the device allocates different right-of-way levels to different vehicles with different functions, and the device includes a control center of an Intelligent Transportation System (ITS) and is disposed in a specific place in the ITS; and in response to sending the right-of-way application message:

receiving a right-of-way instruction message sent by the device, wherein the ITS includes the device, a plurality of road resources, and a plurality of vehicles driving on the plurality of road resources, wherein the right-of-way instruction message comprises the right-of-way level of the vehicle, and is used to instruct the vehicle to use the right-of-way level of the vehicle, wherein the right-of-way level of the vehicle is determined by the device according to a function of the vehicle and a mapping relationship between a right-of-way level and a function of a vehicle, wherein the mapping relationship is received from a third-party entity by sending a mapping relationship query message to the third-party entity, wherein the right-of-way level of the vehicle corresponds to one or more road resources in the plurality of road resources, and wherein the function of the vehicle comprises one or more of an emergency function of the vehicle, a public function of the vehicle, or a dedicated function of the vehicle; and using a road resource from the one or more road resources that is scheduled by the device according to the right-of-way level of the vehicle, wherein the road resource from the one or more road resources is scheduled by:

sending, by the device, time constraint information in the one or more road resources for the vehicle, wherein the time constraint information comprises a time coordinate sequence of the vehicle corresponding to the one or more road resources; and receiving, from the device, an available-road set of the vehicle determined based on the time coordinate sequence of the vehicle and the one or more road resources.

* * * * *